US006945721B2

(12) United States Patent
Sato

(10) Patent No.: US 6,945,721 B2
(45) Date of Patent: Sep. 20, 2005

(54) EDGE-DETECTING DEVICE AND IMAGE-FORMING DEVICE PROVIDED WITH THE SAME

(75) Inventor: Tatsuya Sato, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/724,185

(22) Filed: Dec. 1, 2003

(65) Prior Publication Data

US 2005/0100385 A1 May 12, 2005

(30) Foreign Application Priority Data

Nov. 29, 2002 (JP) ..... 2002-348269

(51) Int. Cl.[7] ..... B41J 11/44

(52) U.S. Cl. ..... 400/708; 400/76; 400/70; 400/61

(58) Field of Search ..... 400/708, 76, 70, 400/61

(56) References Cited

U.S. PATENT DOCUMENTS

| | | | | | |
|---|---|---|---|---|---|
| 5,610,721 | A | * | 3/1997 | Higuchi et al. | 358/296 |
| 5,618,120 | A | | 4/1997 | Ishikawa | 400/708 |
| 6,257,569 | B1 | * | 7/2001 | Rhodes et al. | 271/117 |
| 6,302,510 | B1 | * | 10/2001 | Yoshida | 347/19 |
| 6,348,697 | B1 | * | 2/2002 | Kitajima | 250/559.4 |
| 6,390,703 | B1 | * | 5/2002 | Kinas et al. | 400/708 |
| 6,637,852 | B2 | * | 10/2003 | Bjune | 347/16 |
| 6,753,975 | B1 | * | 6/2004 | Hanson | 358/1.18 |
| 2003/0080487 | A1 | * | 5/2003 | Tamura et al. | 270/58.07 |
| 2004/0094891 | A1 | * | 5/2004 | Trovinger et al. | 271/227 |

FOREIGN PATENT DOCUMENTS

| | | | |
|---|---|---|---|
| JP | U 63-49955 | 4/1988 | |
| JP | U 2-40559 | 3/1990 | |
| JP | U-03-68093 | 7/1991 | |
| JP | A-05-032026 | 2/1993 | |
| JP | B2 7-28371 | 3/1995 | |
| JP | A-07-179248 | 7/1995 | |
| JP | B2 2959193 | 7/1999 | |
| JP | A 2000-109243 | 4/2000 | |
| WO | WO9856699 | * 12/1998 | ..... B65H/7/14 |

* cited by examiner

*Primary Examiner*—Charles H. Nolan, Jr.
(74) *Attorney, Agent, or Firm*—Oliff & Berridge, PLC

(57) ABSTRACT

An image-forming device includes a media sensor having a light-emitting element and a light-receiving element for detecting edge positions of a paper based on values outputted from the light-receiving element as the target detection area of the media sensor is moved in relation to the paper. The value of a current to be supplied to the light-emitting element for edge detection is determined in the following manner. First, the media sensor is moved to the center of the paper-conveying path (S110). Then, the paper is conveyed to a prescribed position (S120–S150). Next, the value of the current that should be supplied to the light-emitting element (light amount adjusting value) in order that output from the light-receiving element will reach a desired value is determined at a position A on the paper at which the target detection area of the media sensor is being presently located (S160, S170). The target detection area is subsequently moved to a position B and a position C, while repeating the process to determine the light amount adjusting value (S180–S230). Finally, the paper edge detecting current is set to the smallest of the light amount adjusting values determined at positions A–C (S240).

16 Claims, 13 Drawing Sheets

EDGE-DETECTING DEVICE AND IMAGE-FORMING DEVICE PROVIDED WITH THE SAME

BACKGROUND OF THE INVENTION

1. Field of the Invention

The present invention relates to an edge-detecting device and an image-forming device such as a printer provided with the edge-detecting device.

2. Description of Related Art

Conventional image-forming devices such as ink-jet printers that form images on a recording medium while conveying that recording medium detect the edge positions of the recording medium in order to position the images on the recording medium with accuracy.

Japanese unexamined patent application publication No. 2000-109243, for example, discloses an image-forming device including an optical sensor having a light-emitting unit that irradiates light and a light-receiving unit that detects the irradiated light reflected off a recording medium. This image-forming device determines the existence of a recording medium based on whether the detection value of the optical sensor is greater than a threshold value. The image-forming device detects the edge positions of the recording medium by monitoring detection values from the optical sensor while moving the optical sensor in relation to the recording medium. The image-forming device having this construction adjusts the amount of light emitted from the light-emitting unit of the optical sensor in order to detect the edge positions of the recording medium accurately without being influenced by properties of the optical sensor, variations in the mounting position of the optical sensor, differences in the reflectance of the recording medium, and the like. Specifically, the amount of light emitted by the light-emitting unit is adjusted so that the amount of light received by the light-receiving unit of the optical sensor from one specific position on the recording medium will attain a target value.

SUMMARY OF THE INVENTION

However, there will be the case that the recording medium is partially soiled or has preprinted images such as logos or pictures. There will be another case that the recording medium has wrinkled areas. If the amount of light emitted by the light-emitting unit is adjusted so that the amount of light received by the light-receiving unit from such a soiled, printed, or wrinkled position on the recording medium will attain the target value, the light-emitting unit is adjusted to emit light of an inappropriate amount. This decreases accuracy for detecting the edge positions of the recording medium.

In view of the foregoing, it is an object of the present invention to provide an improved edge-detecting device that is capable of accurately detecting the edge positions of a recording medium without being affected by differences in states in respective parts of the recording medium and an improved image-forming device provided with the edge-detecting device.

In order to attain the above and other objects, the present invention provides an edge-detecting device for detecting an edge of a medium, the device comprising: a detecting unit that defines a target detection area, and that detects medium detection data at the target detection area, the medium detection data having a different value depending on whether or not a medium is present in the target detection area; an adjusting unit that performs an adjusting operation by controlling the detecting unit to detect values of the medium detection data at a plurality of locations on the medium, thereby adjusting a determining condition based on the plurality of detected values; and an edge detecting unit that performs an edge detecting operation by controlling the detecting unit to detect a value of the medium detection data while moving the position of the target detection area in relation to the medium and by determining whether or not the medium is present in the target detection area based on the value detected by the detecting unit and by using the adjusted determining condition, thereby detecting an edge position of the medium.

According to another aspect, the present invention provides an image-forming device for forming images on a recording medium, the device comprising: a conveying unit that conveys the recording medium in a recording-medium conveying direction; a recording unit that moves substantially orthogonal to the recording-medium conveying direction and that performs a recording operation to form images on the recording medium; and an edge-detecting device that detects an edge of a medium, the edge-detecting device including: a detecting unit that defines a target detection area and that detects medium detection data at the target detection area, the medium detection data having a different value depending on whether or not a medium is present in the target detection area; an adjusting unit that performs an adjusting operation by controlling the detecting unit to detect values of the medium detection data at a plurality of locations on the medium, thereby adjusting a determining condition based on the plurality of detected values; and an edge detecting unit that performs an edge detecting operation by controlling the detecting unit to detect a value of the medium detection data while moving the position of the target detection area in relation to the medium and by determining whether or not the medium is present in the target detection area based on the value detected by the detecting unit and by using the adjusted determining condition, thereby detecting an edge position of the medium, the edge detecting unit detecting both side edge positions of the recording medium that is conveyed by the conveying unit, the recording unit performing the recording operation between both side edge positions of the recording medium detected by the edge detecting unit.

BRIEF DESCRIPTION OF THE DRAWINGS

In the drawings:

FIG. 2(*b*) is a front view showing a paper guide mechanism of the multifunction device in FIG. 1;

DETAILED DESCRIPTION OF THE PREFERRED EMBODIMENTS

Figure 1:
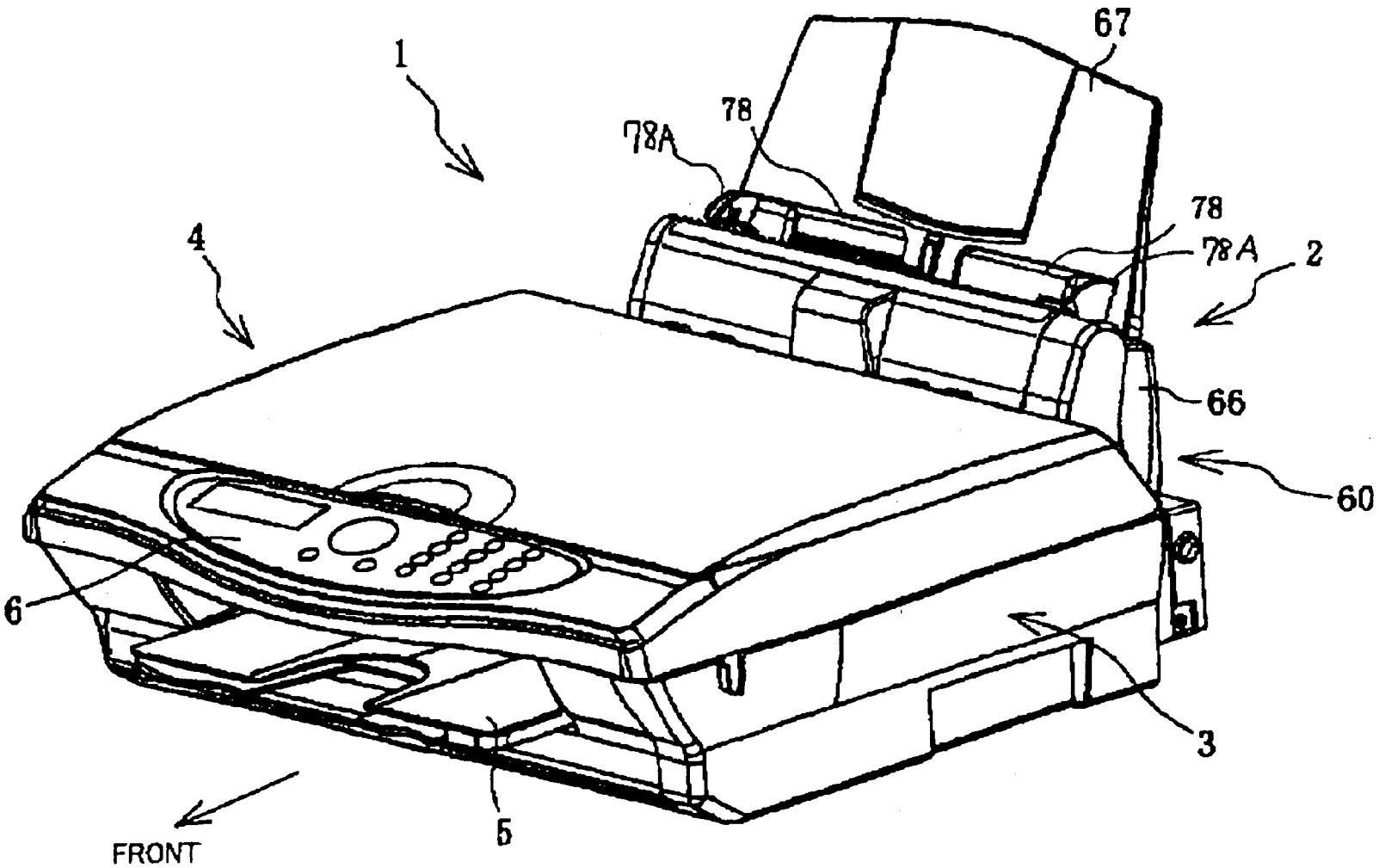
FIG. 1 is a perspective view showing a multifunction device according to a first preferred embodiment of the present invention.

An edge-detecting device and an image forming device according to preferred embodiments of the present invention will be described while referring to the accompanying drawings wherein like parts and components are designated by the same reference numerals to avoid duplicating description.

In the preferred embodiments, the present invention is applied to a multifunction device having a printer function, a copier function, a scanner function, a facsimile function, a telephone function, and the like.

<First Embodiment>

FIG. 1 is a perspective view of the multifunction device 1 of a first embodiment of the present invention.

As shown in FIG. 1, a paper supplying unit 2 is provided in the rear section of the multifunction device 1. An inkjet printer 3 is provided in front of and below the paper supplying unit 2. A scanning unit 4 for implementing the copier function and facsimile function is provided above the printer 3. A discharge tray 5 is provided on the front side of the printer 3. An operating panel 6 is provided on the top surface on the front end of the scanning unit 4.

Figure 2A:
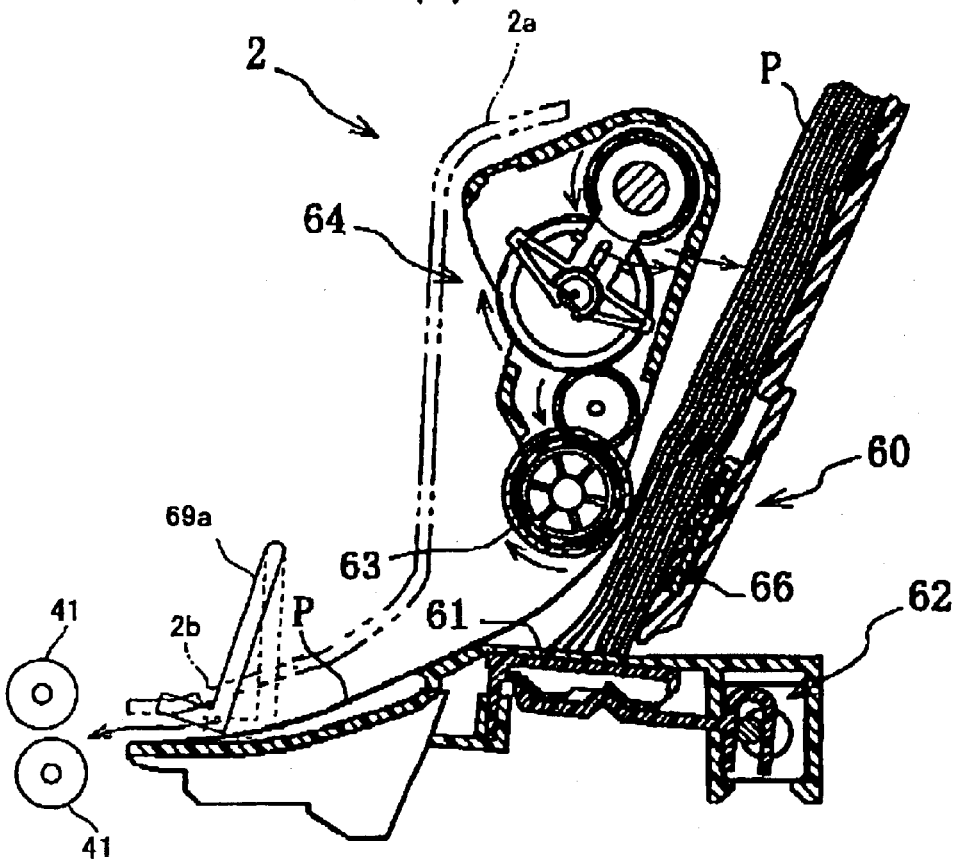
FIG. 2(*a*) is a vertical cross-sectional view showing a paper-supplying unit of the multifunction device in FIG. 1.
Figure 2B:
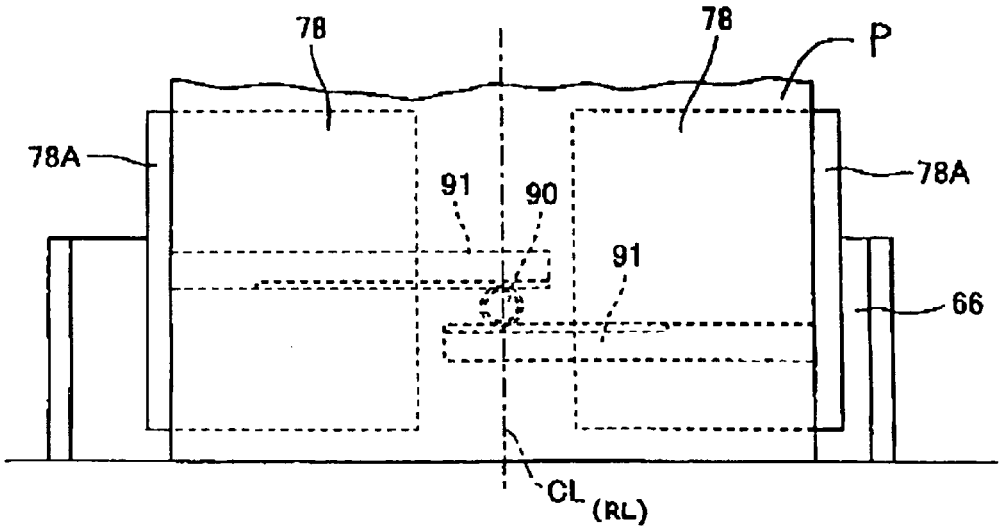

Next the paper-supplying unit 2 will be described in greater detail. FIG. 2 is a vertical cross-sectional view showing the paper-supplying unit 2 of the multifunction device 1.

Figure 7:
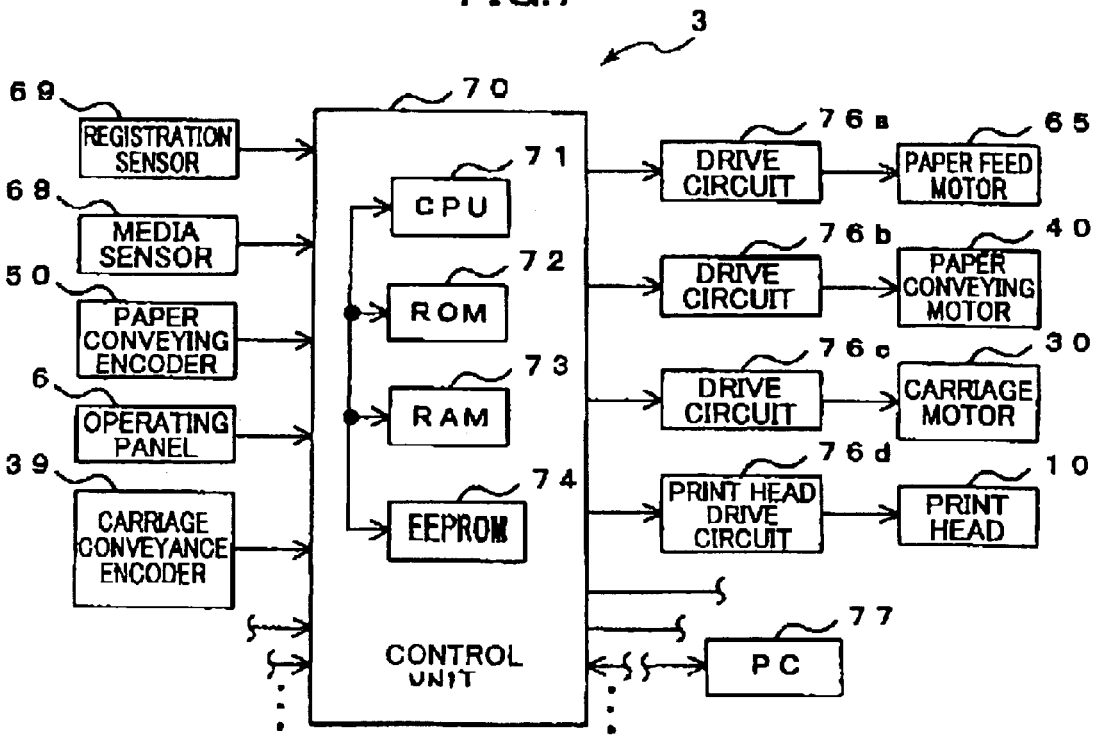
FIG. 7 is a block diagram showing the electrical construction of the printer.

As shown in FIG. 2(*a*), the paper-supplying unit 2 includes a paper holder 60, a pair of left and right stoppers 61, a stopper position switching mechanism 62, a paper-supplying mechanism 64 having a paper-feeding roller 63, and a paper feed motor 65 (see FIG. 7). The paper holder 60 holds a paper P, serving as the recording medium, in a sloped posture. The pair of left and right stoppers 61 is disposed on the bottom surface side of the paper holder 60. The stopper position switching mechanism 62 toggles the pair of left and right stoppers 61 between an upper position and a lower position. The paper-feeding roller 63 supplies the paper P loaded on the paper holder 60. The paper feed motor 65 drives the stopper position switching mechanism 62 and the paper-supplying mechanism 64.

The paper holder 60 has a sloped wall section 66, which is formed integrally with the printer case. An extended paper guide plate 67 (see FIG. 1) is detachable to the sloped wall section 66. A pair of paper guides 78 are provided on the sloped wall section 66 for holding the left and right sides of the paper P, as shown in FIG. 1. When either one of the paper guides 78 is moved in the left or right direction, the other paper guide 78 follows this movement by moving in the opposite direction. In other words, the left and right paper guides 78 are configured to move symmetrically to one another in a left-to-right direction. Hence, the widthwise center of the paper P is always fixed in the same position regardless of the size of the paper P.

This paper guide mechanism will be described in more detail with reference to FIG. 2(*b*). In this drawing, the extended paper guide plate 67 is detached from the sloped wall section 66.

The pair of paper guides 78 are mounted on the front surface of the sloped wall section 66 as indicated by broken lines in the figure. Papers P are stacked on the pair of paper guides 78. Each paper guide 78 is in a plate shape and has a side wall 78A at its edge. More specifically, a right-side paper guide 78 has its side wall 78A on its right edge, while the left-side paper guide 78 has its side wall 78A on its left edge. Each side wall 78A protrudes forwardly from the corresponding paper guide 78, and extends along the sheet conveying direction.

A pinion 90 is mounted on the rear side of the sloped wall section 66 at a predetermined position as indicated by another broken line in FIG. 2(*b*). The pinion 90 is rotatably supported on the sloped wall section 66. A pair of racks 91 are also mounted on the rear side of the sloped wall section 66 as indicated also by broken lines. The racks 91 are supported as being movable in the widthwise direction along the rear side of the sloped wall section 66. Although not shown in the drawing, a pair of through-holes are formed in the sloped wall section 66. The through-holes are elongated in the widthwise direction. Each rack 91 is attached to a corresponding paper guide 78 via a corresponding through-hole. The pair of racks 91 are engaged with the pinion 90 at their positions that are separated from their corresponding side walls 78A at the same distance. The engagement of the racks 91 and the pinion 90 allows the pair of paper guides 78 to move along the widthwise direction by the same amounts in the opposite directions. When the user mounts the sheets of paper P on the pair of paper guides 78, the user moves the pair of paper guides 78 in the widthwise direction until the side walls 78A abut against both side edges of the papers P. The pair of paper guides 78 hold the papers P while the papers P are conveyed one by one in the sheet conveying direction. The paper guides 78 prevent movement of the papers P in the widthwise direction while they are conveyed in the sheet conveying direction. The pair of paper guides 78 guide the sheets of paper P along the sheet conveying direction, while maintaining the central line CL of the papers P to pass through the center of the pinion 90. The central line CL is elongated along the lengthwise direction of the sheets of paper P. An imaginary line that extends in the sheet conveying direction and that passes through the center of the pinion 90 will be referred to as a reference line (center line) RL of the sheet-conveying path. The pair of paper guides 78 therefore guide the sheets of paper P along the sheet conveying direction, while maintaining the central line CL of the papers P to be located exactly on the reference line RL.

Next the printer 3 will be described in greater detail.

Figure 3:
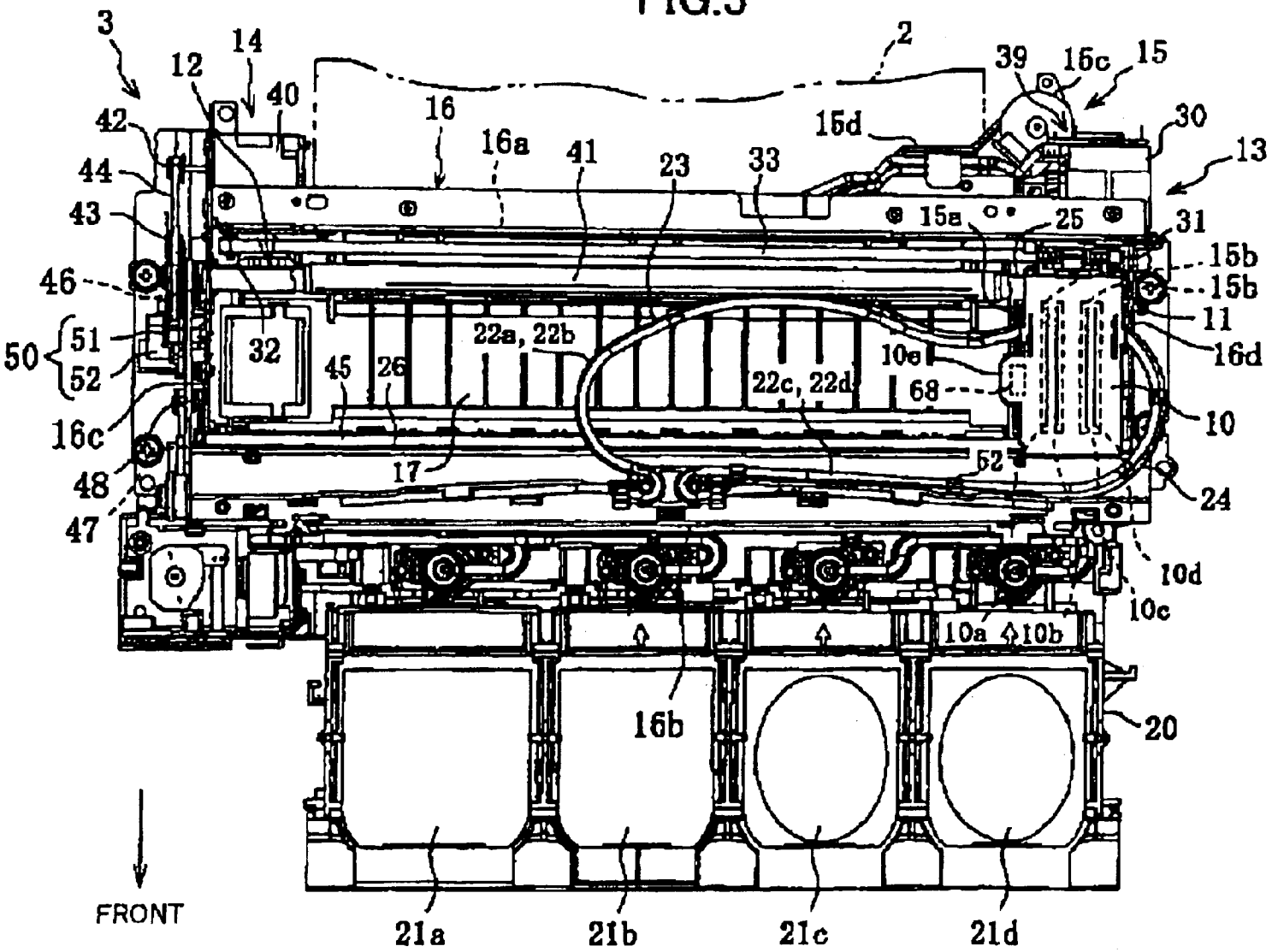
FIG. 3 is a plan view showing the internal construction of a printer provided in the multifunction device.
Figure 4:
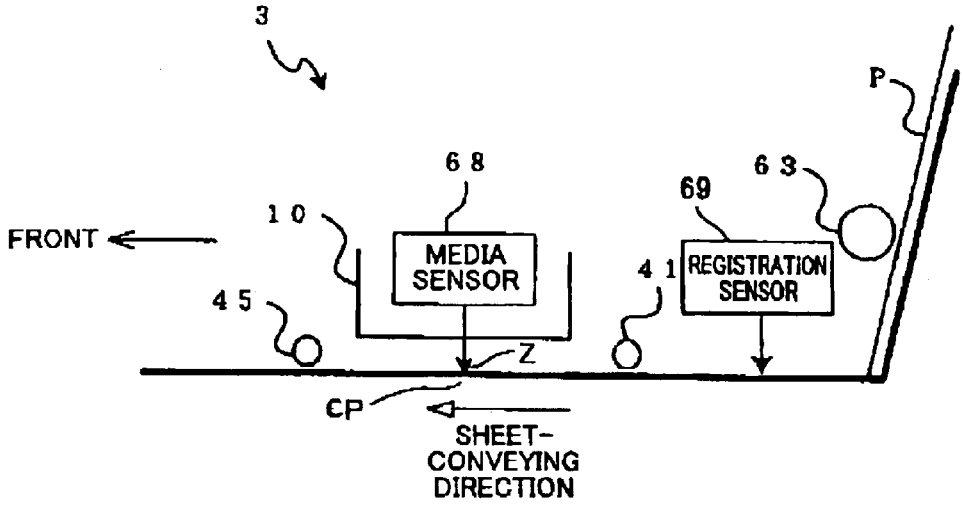
FIG. 4 is an explanatory diagram showing the arrangement of principle components in the printer.

As shown in FIGS. 3 and 4, the printer 3 includes a print head 10, a carriage 11, a guide mechanism 12, a carriage moving mechanism 13, a paper conveying mechanism 14, and a maintenance mechanism 15 for the print head 10. The print head 10 is mounted on the carriage 11. The guide mechanism 12 supports and guides the carriage 11 so that the carriage 11 can move reciprocally in a scanning direction, which is the left-to-right direction in FIG. 3. The carriage moving mechanism 13 moves the carriage 11 in the left-to-right direction. The paper conveying mechanism 14 conveys paper supplied by the paper supplying unit 2.

A rectangular frame 16 that is long in the left-to-right dimension and that is short in the front-to-rear direction is provided in the printer 3. Various components are mounted on the rectangular frame 16, including the guide mechanism 12, carriage moving mechanism 13, paper conveying mechanism 14, and maintenance mechanism 15. The print head 10 and carriage 11 are also accommodated inside the rectangular frame 16 so as to be capable of moving reciprocally left and right.

The rectangular frame 16 includes a rear plate 16*a* and a front plate 16*b*. A paper introducing opening and paper discharging opening (not shown) are formed in the rear plate 16*a* and front plate 16*b*, respectively. Paper supplied by the paper supplying unit 2 is introduced into the rectangular frame 16 via the paper introducing opening, conveyed to the front of the rectangular frame 16 by the paper conveying mechanism 14, and discharged through the paper discharging opening onto the discharge tray 5 (FIG. 1) on the front of the multifunction device 1. A black platen 17 having a plurality of ribs is mounted on the bottom surface of the rectangular frame 16. The print head 10 performs a printing operation on paper inside the rectangular frame 16 as the paper moves over the black platen 17.

The print head 10 is provided with four sets of ink nozzles 10*a*–10*d* that point downward. Paper is printed on by ejecting four colors (black, cyan, yellow, and magenta) of ink downward through these sets of ink nozzles 10*a*–10*d*. Since the four sets of ink nozzles 10*a*–10*d* are disposed on the bottom side of the print head 10, their positions are represented by broken lines in FIG. 2.

Ink cartridges 21*a*–21*d* for each of the four colors are mounted in a cartridge holder 20 on the front side of the rectangular frame 16. The ink cartridges 21*a*–21*d* are connected to the print head 10 via four flexible ink tubes 22*a*–22*d* that pass through the rectangular frame 16 in order to supply ink of each of the four colors to the print head 10.

Left and right flexible printed circuits (FPC) 23 and 24 are disposed inside the rectangular frame 16. The left FPC 23 extends together with the flexible ink tube 22*a* and flexible ink tube 22*b* and connects to the print head 10. The right FPC 24 extends together with the flexible ink tube 22*c* and flexible ink tube 22*d* and connects to the print head 10. The left FPC 23 and right FPC 24 include a: plurality of signal lines that electrically connect the print head 10 to a control process unit 70 (shown in FIG. 7) described later.

The guide mechanism 12 has a guide shaft 25 and a guide rail 26. The guide shaft 25 extends left-to-right in the back part of the rectangular frame 16. The left and right ends of the guide shaft 25 are coupled with a left plate 16*c* and a right plate 16*d*, respectively, of the rectangular frame 16. The guide rail 26 extends left-to-right in the front part of the rectangular frame 16. The rear end of the carriage 11 is fitted over the guide shaft 25 so as to be capable of sliding along the same, while the front end of the carriage 11 is engaged with the guide rail 26 and capable of sliding along the same.

The carriage moving mechanism 13 includes a carriage motor 30, a drive pulley 31, a follow pulley 32, and a belt 33. The carriage motor 30 is mounted on the rectangular frame 16 at the rear side of the rear plate 16*a* on the right end and facing front. The drive pulley 31 is rotatably supported on the right end of the rear plate 16*a* and is driven to rotate by the carriage motor 30. The follow pulley 32 is rotatably supported on the left end of the rear plate 16*a*. The belt 33 is looped around the pulleys 31 and 32 and fixed to the carriage 11. A carriage conveyance encoder 39 is disposed near the carriage motor 30 for detecting movement (position) of the carriage 11 (print head 10).

The paper conveying mechanism 14 includes a paper conveying motor 40, a registration roller 41, a drive pulley 42, a follow pulley 43, and a belt 44. The paper conveying motor 40 is mounted facing leftward on the portion of the left plate 16*c* that protrudes further rearward than the rear plate 16*a*. The registration roller 41 extends in the left-to-right direction in the rectangular frame 16 below the guide shaft 25. The left and right ends of the registration roller 41 are rotatably supported in the left plate 16*c* and right plate 16*d*, respectively. The drive pulley 42 is driven to rotate by the paper conveying motor 40. The follow pulley 43 is coupled to the left end of the registration roller 41. The belt 44 is looped around the pulleys 42 and 43. When the paper conveying motor 40 is driven, the registration roller 41 rotates and conveys paper in the rear-to-front direction. While the registration roller 41 is emphasized in FIG. 3, the registration roller 41 is actually disposed beneath the guide shaft, 25.

The paper conveying mechanism 14 further includes a discharge roller 45, a follow pulley 46, a follow pulley 47, and a belt 48. The discharge roller 45 extends in the left-to-right direction in the front section of the rectangular frame 16. The left and right ends of the discharge roller 45 are rotatably supported in the left plate 16*c* and right plate 16*d*, respectively. The follow pulley 46 is integrally provided with the follow pulley 43. The follow pulley 47 is coupled to the left end of the discharge roller 45. The belt 46 is looped around the pulleys 46 and 47. When the paper conveying motor 40 is driven, the discharge roller 45 rotates and discharges paper toward the discharge tray 5 in the front of the multifunction device 1.

An encoder disk 51 is fixed to the follow pulley 43. A photo interrupter 52 having a light-emitting unit and a light-receiving unit is mounted on the left plate 16*c* such that the encoder disk 51 is interposed between the light-emitting unit and light-receiving unit. The encoder disk 51 and photo interrupter 52 together make up a paper conveying encoder 50. The control process unit 70 described later controls the driving of the paper conveying motor 40 based on detection signals from the paper conveying encoder 50 (more specifically, from the photo interrupter 52).

The maintenance mechanism 15 includes a wiper 15*a*, two caps 15*b*, and a drive motor 15*c*. The wiper 15*a* wipes the surface of the print head 10. Each of the caps 15*b* can hermetically seal two sets of the ink nozzles 10*a*–10*d*. The drive motor 15*c* drives both of the wiper, 15*a* and caps 15*b*. The wiper 15*a*, caps 15*b*, and drive motor 15*c* are mounted on a mounting plate 15*d*. The mounting plate 15*d* is fixed to the lower surface side of the bottom plate of the rectangular frame 16 at its right portion. Since the caps 15*b* are disposed on the bottom side of the print head 10, dotted lines indicate the positions of the caps 15*b* on the opposite side in FIG. 2.

Figure 5:
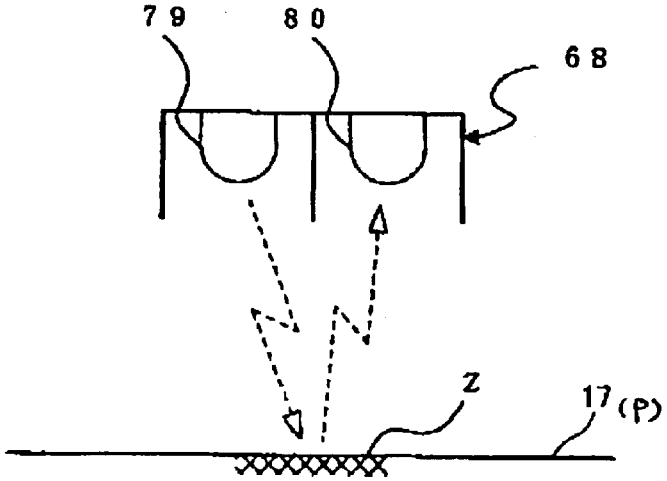
FIG. 5 is an explanatory diagram illustrating the operations of a media sensor employed in the printer.

A sensor mounting unit 10*e* protrudes from the left side of the print head 10. A media sensor 68 is mounted on the sensor mounting unit 10*e* for detecting the leading edge, trailing edge, and side edges of the paper P. As shown in the explanatory diagram of FIG. 5, the media sensor 68 is a reflection-type optical sensor that includes a light-emitting element 79 (light-emitting diode in the preferred embodiment) and a light-receiving element 80 (phototransistor in the preferred embodiment). A target detection area Z is defined for the media sensor 68 as such an area that when the media sensor 68 emits light from the light-emitting element 79, light reflected from the target detection area Z will be received by the light-receiving element 80. The target detection area Z moves together with the carriage 11 when the carriage 11 moves in the carriage moving direction. When the paper P is not present on the target detection area Z, the light-receiving element 80 receives light reflected from the black platen 17. The amount of light received by the light-receiving element 80 approaches a value of zero (0). When the paper P is present on the target detection area Z, the light-receiving element 80 receives a much larger amount of reflected light from the paper P than when the paper P is absent on the target detection area Z. This is because the paper P is generally white in color. Hence, the output value from the media sensor 68 (specifically, the voltage outputted by the light-receiving element 80) is at the HIGH level when the paper P is present on the target detection area Z and at the LOW level when the paper P is not present on the target detection area Z.

As shown in FIG. 4, the media sensor 68 moves together with the print head 10 along a carriage moving path CP, which extends perpendicular to the sheet conveying direction. In FIG. 4, the carriage moving path CP extends normal to the sheet of paper. The target detection area Z therefore moves together with the print head 10 when the print head 10 moves along the carriage moving path CP.

A registration sensor 69 is disposed upstream of the carriage moving path CP and the registration roller 41 in the conveying direction of the paper P.

Figure 6:
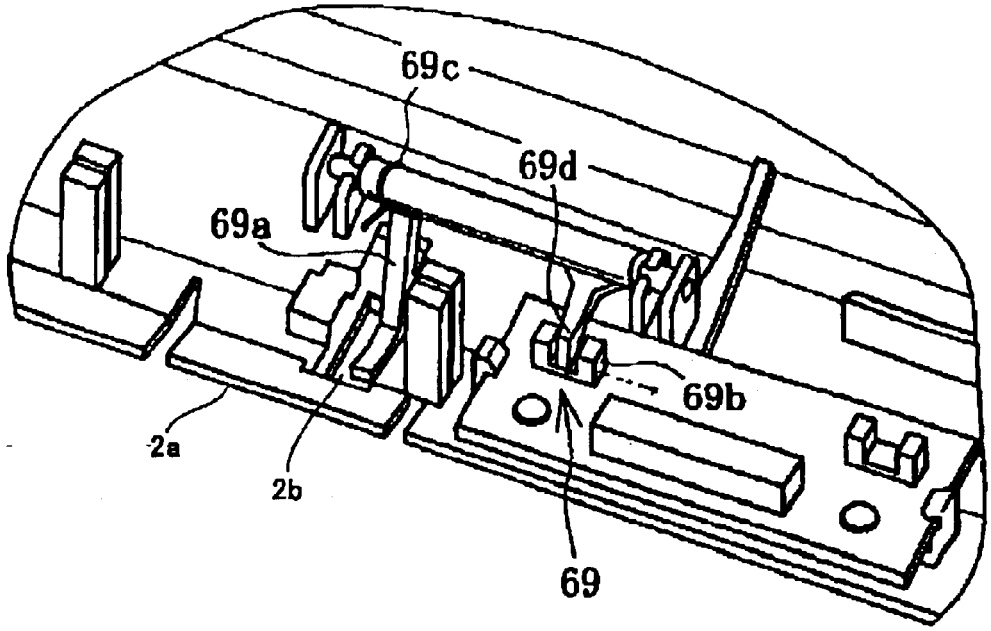
FIG. 6 is a partial perspective view showing a registration sensor employed in the printer.

As shown in FIG. 6, the registration sensor 69 is mounted on a top cover 2*a* at its-position near to the front end thereof. It is noted that the top cover 2*a* is provided on the paper-supplying unit 2 and forms a conveying path for the paper P as shown in FIG. 2(*a*). The registration sensor 69 can detect the existence of the paper P, as well as the leading edge and trailing edge of the paper P.

The registration sensor 69 is a mechanical sensor having a probe 69*a*, a photo interrupter 69*b*, and a torsion spring 69*c*. An opening 2*b* is formed through the top cover 2*a*. The probe 69*a* protrudes through the opening 2*b* into the paper-conveying path as shown in FIG. 2(*a*). When the paper P is not in contact with the probe 69*a*, the probe 69*a* is in the location indicated by the broken line. However, when the probe 69*a* is contacted by the paper P, the probe 69*a* rotates into another location that is indicated by the solid line.

As shown in FIG. 6, the photo interrupter 69*b* includes a light-emitting unit and a light-receiving unit for detecting rotation of the probe 69*a*. The torsion spring 69*c* urges the probe 69*a* into the paper-conveying path. A shielding part 69*d* is integrally provided on the probe 69*a*. When the probe 69*a* is rotated by contact from the paper P, the shielding part 69*d* becomes positioned in a space outside the area between the light-emitting unit and the light-receiving unit of the photo interrupter 69*b*. Hence, the shielding part 69*d* does not block the transmission of light from the light-emitting unit to the light-receiving unit, and the registration sensor 69 is in an ON state. However, when the paper P is not being conveyed, the probe 69*a* is urged into the paper-conveying path by the torsion spring 69*c*, thereby positioning the shielding part 69*d* between the light-emitting unit and light-receiving unit of the photo interrupter 69*b*. Hence, the shielding part 69*d* interrupts the transmission of light from the light-emitting unit to the light-receiving unit, placing the registration sensor 69 in an OFF state.

It is noted that the registration sensor 69 (more specifically the probe 69*a*) is disposed at a position through which the paper P always passes. For example, the probe 69*a* is located on the centerline (reference line RL) of the sheet conveying path that is defined by a line that passes through the center of the pinion 90 (FIG. 2(*b*)) and that extends along the sheet conveying direction. It is ensured that the sheet P always contacts the probe 69*a* when the sheet P is conveyed on the sheet conveying path.

Next, the electrical construction of the ink-jet printer 3 will be described with reference to the block diagram of FIG. 7.

As shown in FIG. 7, the inkjet printer 3 includes a control unit 70 having a CPU 71, a ROM 72, a RAM 73, and an EPROM 74.

The control unit 70 is electrically connected to the registration sensor 69, the media sensor 68, the paper conveyance encoder 50, the operating panel 6, and the carriage conveyance encoder 39. The control unit 70 is also electrically connected to drive circuits 76*a*–76*c* and a print head drive circuit 76*d*. The drive circuit 76*a* drives the paper feed motor 65; the drive circuit 76*b* drives the paper conveying motor 40; the drive circuit 76*c* drives the carriage motor 30; and the print drive circuit 76*d* drives the print head 10.

In the preferred embodiment, the control unit 70 is also connected to and capable of communicating with a personal computer 77. In accordance with print commands transmitted from the personal computer 77, the control unit 70 performs a printing process that is well known in the art for printing an image on the paper P based on image data transmitted along with the print commands. The print commands transmitted from the personal computer 77 include data defining the size of the paper (A4, B5, etc.) on which the image is to be printed.

The control unit 70 performs a process to detect the edges of the paper P in order to position the image on the paper P accurately. Specifically, the control unit 70 controls the media sensor 68 so that the light-emitting element 79 emits light, and detects the amount of light received by the light-receiving element 80, while moving the carriage 11 to move the position of the target detection area Z relative to the paper P. The control unit 70 determines whether the paper P is present on the target detection area Z based on the amount of received light.

The following points (1)–(3) are conditions for determining whether the paper P is present in the target detection area Z:

(1): The light-emitting element 79 is controlled to emit a fixed amount of light. Specifically, a constant electric current (hereinafter referred to as a paper edge detecting current) is supplied to the light-emitting element 79.

(2): The amount of light received by the light-receiving element 80 is detected while the light-emitting element 79 is emitting light as described in (1). Specifically, an output value (voltage in the preferred embodiment) from the light-receiving element 80 is detected.

(3): If the output value from the light-receiving element 80 detected in (2) exceeds a threshold value (hereinafter referred to as a paper edge detecting threshold), then it is determined that the paper P is present in the target detection area Z. If the output value from the light-receiving element 80 is smaller than the threshold value, then it is determined that the paper P is not present in the target detection area Z.

Figure 8:
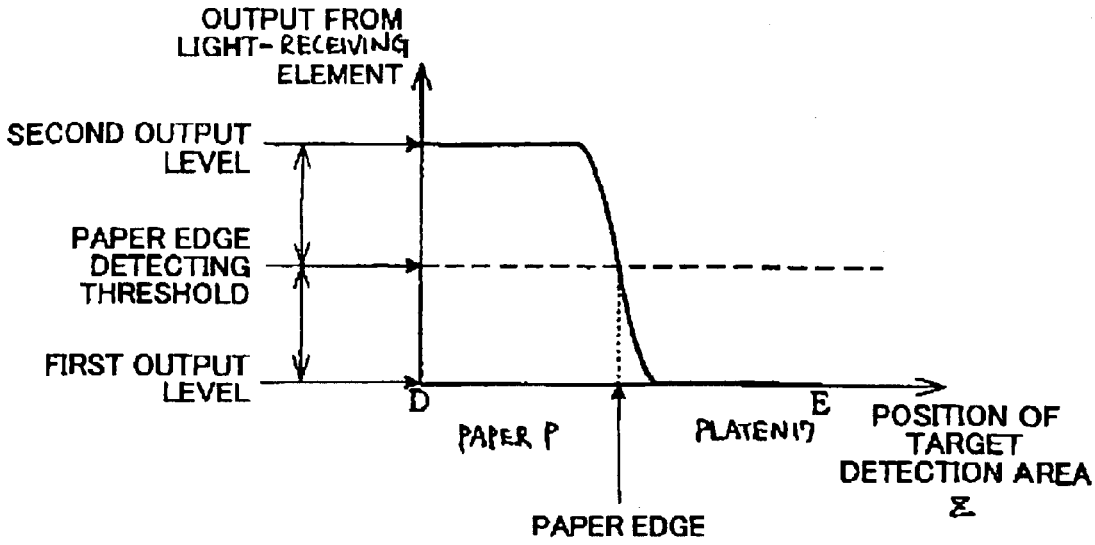
FIG. 8 is a graph showing the relationship between the position of the target detection area and the output value from the light-receiving element.

When the paper P is not present in the target detection area Z, that is, when the black platen 17 is present in the target detection area Z, the output value of the light-receiving element 80 is close to zero (0) as shown in FIG. 8. However, the output value of the light-receiving element 80 obtained when the paper P is present in the target detection area Z is larger than that obtained when the paper P is not present in the target detection area Z. Hence, by setting the paper edge detecting threshold to a value greater than the output value of the light-receiving element 80 that is obtained when the paper P is not present in the target detection area Z (hereinafter referred to as the first output level) and less than the output value of the light-receiving element 80 that is obtained when the paper P is present in the target detection area Z (hereinafter referred to as the second output level), then it is possible to determine whether the paper P is present in the target detection area Z by comparing the output value of the light-receiving element 80 to the paper edge detecting threshold.

It is noted that when the target detection area Z is located at a position near the edge of the paper P, the output value of the light-receiving element 80 changes gradually as the position of the target detection area Z changes as the carriage 11 moves. Therefore, the position detected to be the edge position will vary slightly depending on the amount of the paper edge detecting threshold. Accordingly, by setting the paper edge detecting threshold as a midway value between the first output level and the second output level, it is possible to detect the edge position with high accuracy.

The value of the second output level varies greatly due to such conditions as variations in the performance and the mounting positions of the light-emitting element 79 and the light-receiving element 80, and the type of papers P, such as the density of color of the papers P. Accordingly, prior to detecting the edge position of the paper P, the control unit 70 sets the amount of light to be emitted from the light-emitting element 79 (more accurately, sets the paper edge detecting current to be supplied to the light-emitting element 79) so that the second output level achieves a desired output value (target output value). It is noted that the amount of the target output value can be freely set by the user. However, it is preferable to set the amount of the target output value as such a value that is large enough to differentiate the threshold value from both of the first output level and the second output level (target output value). In other words, the amount of the target output value should be sufficiently large so that a difference of the second output level (target output value) from the first output level will become sufficiently large and so that the threshold value (value midway between the first and second output values) will be sufficiently differentiated from the first and second output values.

The first output level is always near to zero (0) even when conditions change. Accordingly, it is unnecessary to consider changes in the first output level. It is noted, however, that the control unit 70 can be designed to actually detect the amount of the first output level and to modify the amount of the paper edge detection threshold based on the actually-detected value. More specifically, the control unit 70 controls the light-emitting element 79 to emit light at a default value prior to conveying the paper P into the target detection area Z. The control unit 70 sets the amount of the first output level as the output value of the light-receiving element 80 actually obtained at this time. This will reduce the amount of error that will be generated in the output value that the light-receiving element 80 will output in response to light actually received by the light-receiving element 80.

The control unit 70 performs a light amount adjusting process at a plurality of locations on the paper P. That is, the control unit 70 moves the media sensor 68 to the plurality of locations on the paper P. When the media sensor 68 is positioned at each location, the control unit 70 determines the amount of a current that is needed to be supplied to the light-emitting element 79 in order to let the light-emitting element 79 to emit a proper amount of light that allows the light-receiving element 80 to output an output value of the target output value. Based on these results, the control unit 70 sets an amount of the paper edge detecting current that should be supplied to the light-emitting element 79 to perform accurate edge detection. In this way, the paper edge detecting current can be set to an appropriate value even when conditions of the paper P are different at their respective portions. If the light amount adjusting process were performed only on a single specific area of the paper P, if this specific area is soiled, is already printed with some image, or is wrinkled, the specific area will not reflect the normal amount of light and the light-receiving element 80 will output an erroneously too low output level as the second output level. It becomes impossible to set the amount of the paper edge detecting current to an appropriate value. According to the present embodiment, it is possible to prevent the occurrence of such problems by performing the light amount adjusting process on the plurality of areas of the paper P.

Next, the processes executed by the CPU 71 in the control unit 70 will-be described in more detail.

First the process for setting the paper edge detecting current will be described with reference to the flowchart in FIG. 9.

The CPU 71 starts executing the process for setting the paper edge detecting current when the CPU 71 receives a print command from the personal computer 77. It is preferable that the CPU 71 executes this process for each sheet of the paper P in consideration for variations in reflectance of each paper P. However, when using a plurality of papers P that have substantially the same reflectance, the CPU 71 may perform the process for just the first sheet of the paper P in order to increase the overall processing speed.

At the beginning of the process in S110, the CPU 71 drives the carriage motor 30 to move the carriage 11 such that the media sensor 68 is moved along the carriage moving path CP in which the carriage 11 moves (the direction perpendicular to the conveying direction of the paper P) to approximately the center position in the paper conveying path. Specifically, the media sensor 68 is moved 80 that the target detection area Z will be positioned on the widthwise centerline of the paper conveying path. As described above, the widthwise centerline of the paper P is always fixed by the paper guides 78 onto the center line of the sheet-conveying path that extends along the sheet conveying direction and that passes the center of the pinion 90. Accordingly, the widthwise center line of the paper e will always pass over the center line of the conveying path, which serves as the reference line RL in this case. Therefore, the paper P reliably passes through the target detection area Z of the media sensor 68.

As described already, the registration sensor 69 (more specifically the probe 69*a*) is disposed at a position through which the paper P always passes. Hence, the media sensor 68 may be moved to such a position that is located along a line passing through the registration sensor 69 (probe 69*a*) in the paper conveying direction. This ensures that the paper P reliably passes through the target detection area Z of the media sensor 68.

In S120 the CPU 71 begins driving the paper feed motor 65 and the paper-supplying mechanism 64 to convey the paper P.

In S130 the CPU 71 enters a wait state until the registration sensor 69 is in an ON state. In other words, the CPU 71 waits until the registration sensor 69 detects that the paper P has been conveyed. When the registration sensor 69 turns into an ON state, the CPU 71 advances to S140.

In S140 the CPU 71 is in a wait state until the leading edge of the paper P has been detected by the media sensor 68. When the leading edge of the paper P is detected, the CPU 71 advances to S150. Hence, the CPU 71 does not advance to the processes beginning in S150 until after the registration sensor 69 detects that the paper P has been conveyed in S130 and the media sensor 68 detects the leading edge of the paper P in S140.

It is noted that in S140, the paper P is detected using the media sensor 68 by comparing the output value from the light-receiving element 80 to a threshold value that is different from the paper edge detecting threshold described above. A high precision is not required in S140 for detecting the paper leading-edge position of the paper P. However, it is necessary to reliably detect the existence of the paper P, regardless of the type of paper P. Therefore, the threshold value used in S140 is slightly lower than the paper edge detecting threshold. That is, the threshold value is set slightly closer toward the first output level than the paper edge detecting threshold.

Figure 10:
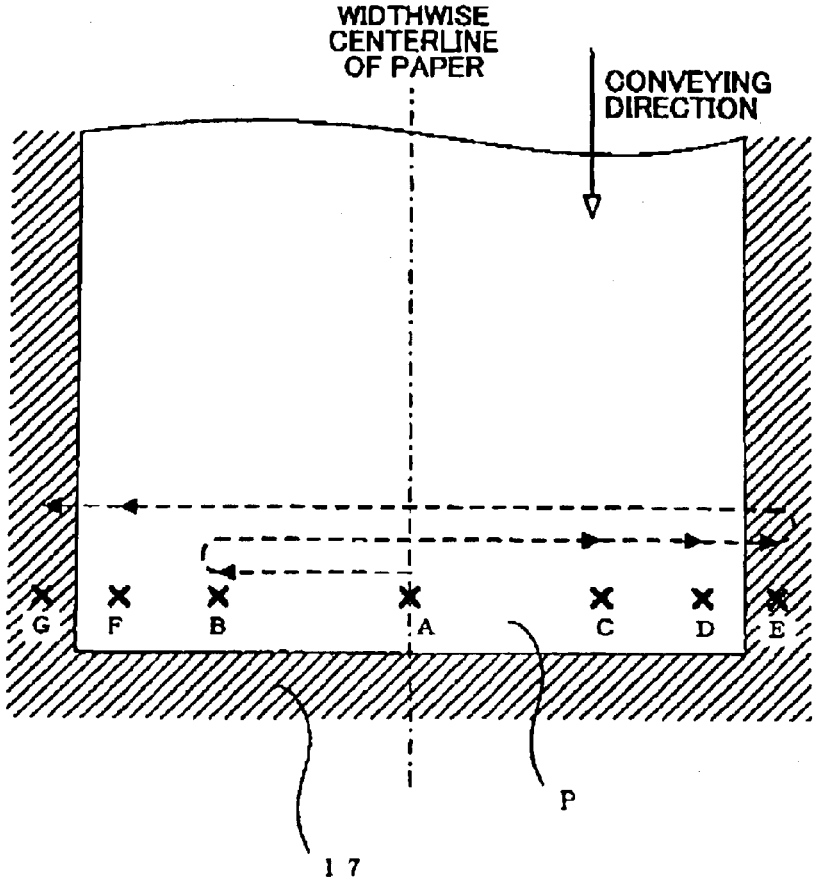
FIG. 10 is a first explanatory diagram showing areas on a paper at which a light adjustment process is performed.

In S150 the CPU 71 stops conveying the paper P, resulting in that the target detection area Z of the media sensor 68 stops at a position A on the paper P, as shown in FIG. 10.

In S160 the CPU 71 performs a light amount adjusting process for determining the amount of an appropriate current value that should be supplied to the light-emitting element 79 (hereinafter, referred to as the light amount adjustment value) in order to let the light-receiving element 80 output an output value of the target output value, in response to light that is emitted from the light-emitting element 79 and that is reflected from the target detection area Z (position A on the sheet of paper P).

Next, the light amount adjusting process of S160 will be described in more detail with reference to the flowchart in FIG. 11.

At the beginning of the light amount adjusting process, in S310, the CPU 71 initializes the amount of the current to be supplied to the light-emitting element 79, and controls the light-emitting element 79 to emit light by supplying the light-emitting element 79 with electric current of the initialized amount. The initial amount should be small enough that the output value of the light-receiving element 80 will not reach the target output value regardless of the type of paper P. For example, the initial amount should be small enough that the output value of the light-receiving element 80 will be equal to zero (0).

In S320 the CPU 71 detects the output value from the light-receiving element 80.

In S330 the CPU 71 determines whether the output value detected in S320 has reached the target output value.

If the CPU 71 determines that the output value has not yet reached the target output value in S330, then in S340 the CPU 71 increases the amount of the current to be supplied to the light-emitting element 79 by a single unit and returns to S320. Hence, the amount of the current supplied to the light-emitting element 79 is increased until the value outputted from the light-receiving element 80 reaches the target output value.

On the other hand, when the CPU 71 determines in S330 that the output value has reached the target value, then in S350 the CPU 71 sets the amount of the current that is now being supplied to the light-emitting element 79 to the light amount adjustment value for the present position (position A at this time), at which the light amount adjustment process is now being performed, and the light amount adjusting process ends.

Figure 9:
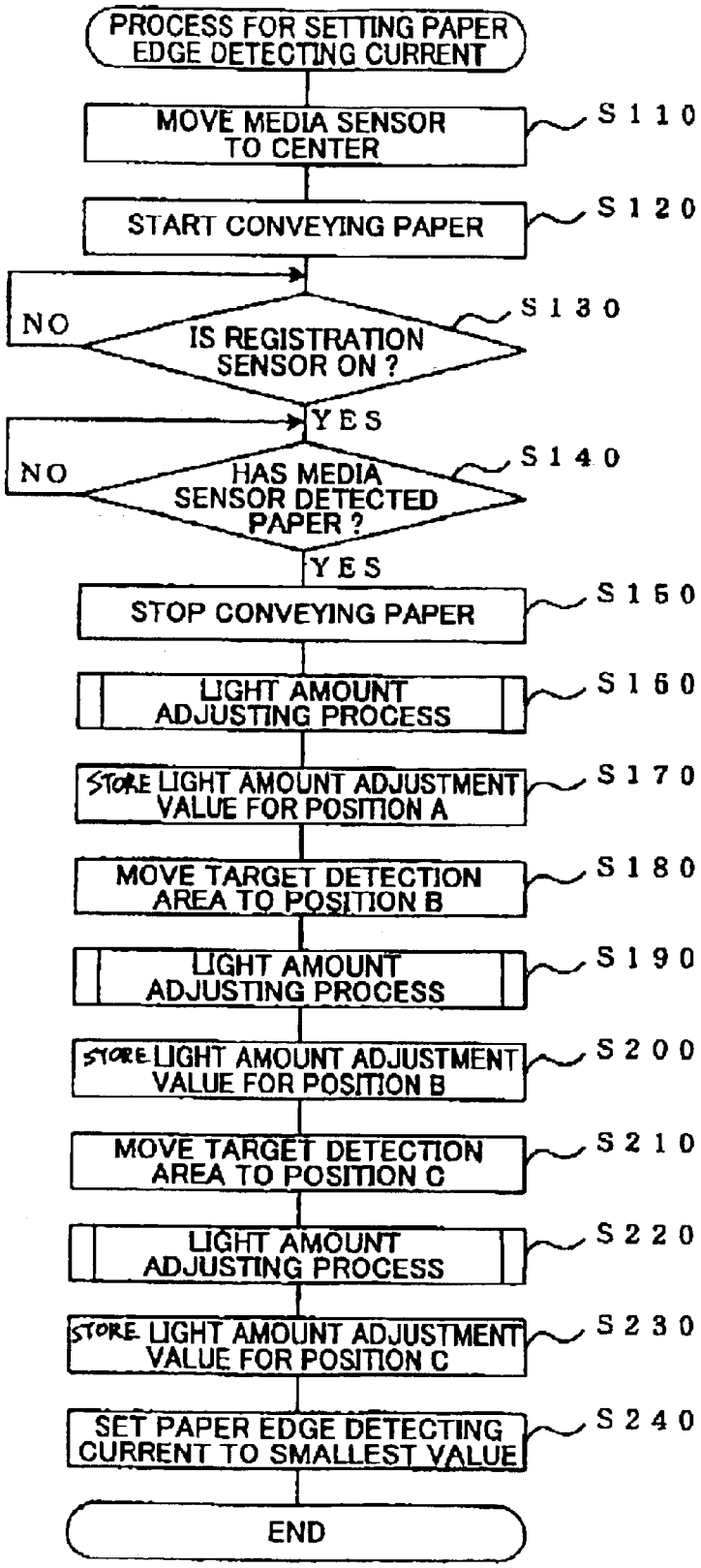
FIG. 9 is a flowchart showing the steps in a process for setting a current value for paper edge detection.

Thereafter, the process proceeds to S170 (FIG. 9).

In S170 the CPU 71 stores, as the light amount adjustment value for position A, the light amount adjustment value that is determined in S160 in the RAM 73.

In S180 the carriage 11 is moved so that the target detection area Z of the media sensor 68 is moved to a position B on the paper P (see FIG. 10). This position B (as with a position C described later) is set in an area inside of the paper P, which is determined based on paper size data included in the print command received from the personal computer 77.

In S190, the light amount adjusting process is executed at position B in the same manner as in S160.

In S200, the CPU 71 stores, as the light amount adjustment value for position B, the light amount adjustment value that is determined in S190 in the RAM 73.

In S210, the carriage 11 is moved so that the target detection area Z of the media sensor 68 is moved to a position C on the paper P (see FIG. 10). This position C is a location symmetrical to the position B with respect to the center line CL of the paper P in the widthwise direction. Thus, the position C is also set within the boundaries of the paper P.

In S220, the light amount adjusting process is executed at position C in the same manner as in S160 and S190.

In S230, the CPU 71 stores, as the light amount adjustment value for position C, the light amount adjustment value that is determined in S220 in the RAM 73.

In S240 the CPU 71 sets the amount of the paper edge detecting current to the smallest value among the light amount adjustment values at positions A, B, and C, which are now stored in the RAM 73. Then, the process for setting the paper edge detecting current ends.

In this way, after setting the light amount adjustment values for the positions A, B, and C, in S240 the CPU 71 sets the paper edge detecting current to the smallest value from among the light amount adjustment values for all the positions A, B, and C. If the position A, B, or C of the paper P were soiled, printed with some images, or wrinkled, the light amount adjustment value for such areas will be determined as higher than a value that should be set to that position. Hence, it is likely that the lower light amount adjustment value is more appropriate. Accordingly, the, paper edge detecting current is set to the smallest value among the light amount adjustment values.

Figure 12:
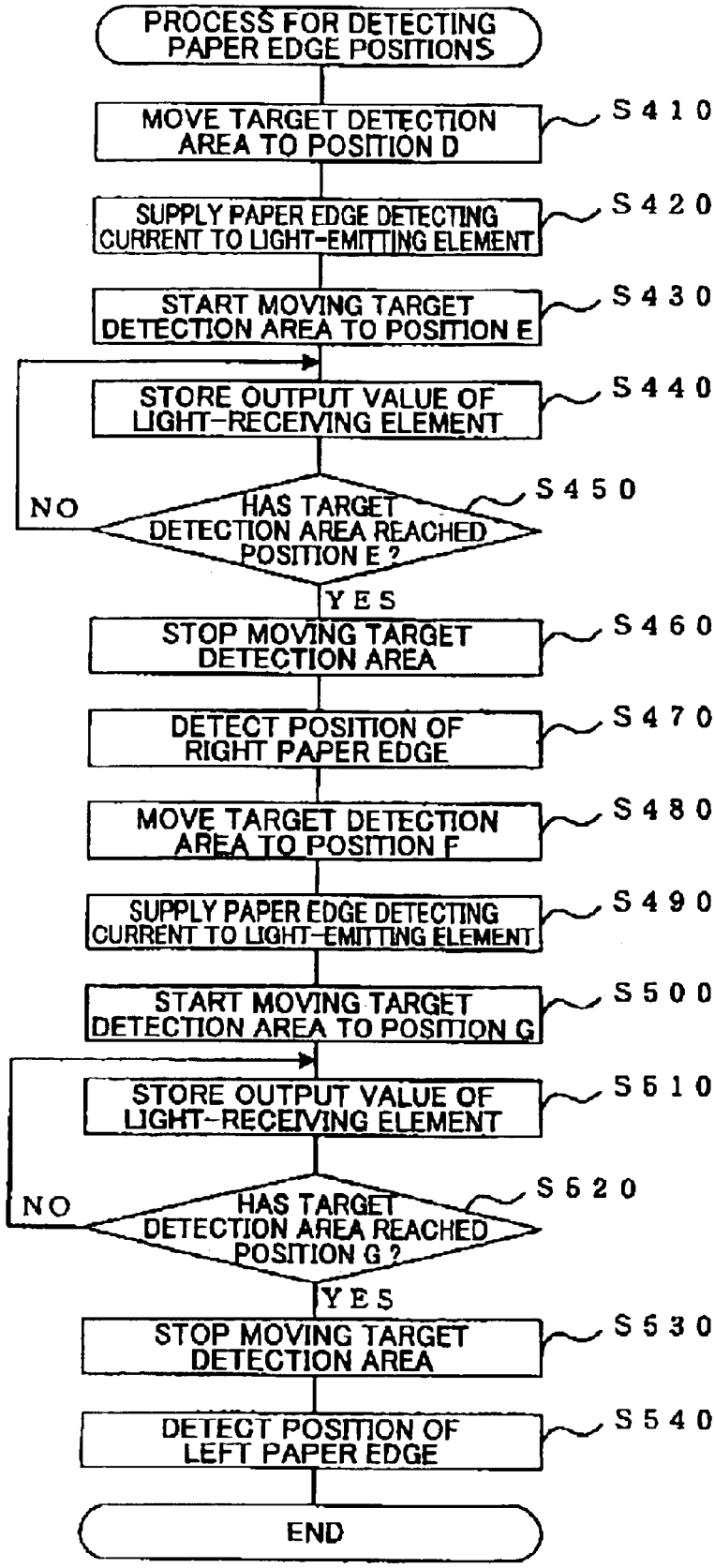
FIG. 12 is a flowchart showing steps in a process to detect paper edge positions.

Next, a process to detect the paper edge positions will be described with reference to the flowchart of FIG. 12. This process begins immediately after completing the process for setting the paper edge detecting current in FIG. 9.

At the beginning of the process to detect the paper edge positions, in S410, the CPU 71 moves the carriage 11 rightward so that the target detection area Z of the media sensor 68 is moved to a position D on the paper P as shown in FIG. 10. The position D is located in an area inside of the paper P but is near to the right edge of the paper P. Thus, position D, as with a position F described later, is set in an area inside of the paper P. This setting is executed based on data for the paper size that is included in the print command received from the personal computer 77.

In S420 the CPU 71 supplies the light-emitting element 79 with the paper edge detecting current of a value that has been determined in the process of FIG. 9, thereby causing the light-emitting element 79 to emit light of the appropriate amount.

In S430 the CPU 71 initiates operations to move the carriage 11 so that the target detection area Z of the media sensor 68 is moved slowly toward a position E outside of the right edge of the paper P as shown in FIG. 10. It is noted that position E, as with a position G described later, is set in an area outside of the paper P. This setting is executed based on data for the paper size that is included in the print command received from the personal computer 77. While the carriage 11 moves, causing the target detection area Z to move from position D to position E, the light-receiving element 80 repeatedly outputs an output value indicative of the amount of the light reflected from the target detection area Z.

In S440 the CPU 71 stores, in the RAM 73, the output values that are repeatedly outputted from the light-receiving element 80 while the target detection area Z is moved together with the carriage 11 from position D to position E.

In S450, the CPU 71 determines whether the target detection-area Z has reached position E based on detection values from the carriage conveyance encoder 39. When it is determined that the target detection area Z has reached position E (yes in S450), in S460 the CPU 71 halts movement of the carriage 11, thereby stopping movement of the target detection area Z.

In S470 the CPU 71 detects the edge position on the right side of the paper P based on the output values that have been outputted from the light-receiving element 80 while the target detection area Z is moved from position D to position E and therefore that have been stored in the RAM 73 in S440.

More specifically, the output value of the light-receiving element 80 changes as shown in FIG. 8 while the target detection area Z is moved from position D to position E. More specifically, a line curve can be produced by plotting the output values as shown in FIG. 8, in which the horizontal axis indicates the position of the target detection area Z and the vertical axis indicates the amount of the output value. The point, at which the line curve intersects the paper edge detecting threshold, is determined to be the right edge position of the paper P.

In S480–S540 described below, the processes the same as those in S410–S470 described above are repeated in order to detect the left edge position of the paper P.

More specifically, in S480, the CPU 71 moves the carriage 11 leftward so that the target detection area Z of the media sensor 68 is moved to a position F on the paper P as shown in FIG. 10. The position F is located in the area inside of the paper P but is near to the left edge of the paper P.

In S490 the CPU 71 supplies the light-emitting element 79 with the paper edge detecting current of a value that has been determined in the process of FIG. 9, thereby causing the light-emitting element 79 to emit light of the appropriate amount.

In S500 the CPU 71 initiates operations to move the carriage 11 so that the target detection area Z of the media sensor 68 is moved slowly toward a position G outside of the left edge of the paper P as shown in FIG. 10. While the carriage 11 moves, causing the target detection area Z to move from position F to position G, the light-receiving element 80 repeatedly outputs an output value indicative of the amount of the light reflected from the target detection area Z.

In S510 the CPU 71 stores, in the RAM 73, the output values that are repeatedly outputted from the light-receiving element 80 while the target detection area Z is moved together with the carriage 11 from position F to position G.

In S520, the CPU 71 determines whether the target detection area Z has reached position G based on detection values from the carriage conveyance encoder 39. When it is determined that the target detection area Z has reached position G (yes in S520), in S530 the CPU 71 halts movement of the carriage 11, thereby stopping movement of the target detection area Z.

In S540, the CPU 71 detects the edge position on the left side of the paper P based on the output values that have been outputted from the light-receiving element 80 while the target detection area Z is moved from position F to position G and therefore that have been stored in the RAM 73 in S510. Then, the process to detect the paper edge positions ends.

With this process, the control unit 70 can accurately detect the edge positions on both the left and right sides of the paper P. After finishing the process of FIG. 12, the printer 3 starts executing a printing operation onto the paper P. Hence, the print head 10 can accurately align the image to be printed with the paper P and can reliably print the image within the left and right edges of the paper P.

As described above, according to the present embodiment, the media sensor 68 has the light-emitting element 79 and the light-receiving element 80 for detecting edge positions of the paper P based on values outputted from the light-receiving element 80 as the target detection area Z of the media sensor 68 is moved in relation to the paper P. The value of a current to be supplied to the light-emitting element 79 for edge detection is determined in the following manner: First, the media sensor 68 is moved to the center of the paper-conveying path (S110). Then, the paper is conveyed to a prescribed position (S120–S150). Next, the value of the current that should be supplied to the light-emitting element 68 (light amount adjusting value) in order that output from the light-receiving element 80 will reach the desired value is determined at a position A on the paper at which the target detection area Z of the media sensor 68 is being presently located (S160, S170). The target detection area Z is subsequently moved to a position B and a position C, while repeating the process to determine the light amount adjusting value (S180–S230). Finally, the paper edge detecting current is set to the smallest of the light amount adjusting values determined at positions A–C (S240).

Thus, it is possible to set an appropriate value for the paper edge detecting current that can accurately detect the edge positions of the paper P, even when portions of the paper P are soiled or contain, images or wrinkles. As a result, the multifunction device 1 can accurately print images up to the very edges of the paper P.

Further, by mounting the media sensor 68 on the print head 10, any additional special construction need not be provided for changing the position of the media sensor 68 relative to the paper P. The position of the media sensor 68 relative to the paper P can be changed by simply moving the print head 10.

Further, conveyance of the paper P is first mechanically detected by the registration sensor 69 and then optically detected by the media sensor 68, enabling the control unit 70 to determine reliably whether the paper P has been conveyed to the target detection area Z of the media sensor 68. It is conceivable to determine whether the paper P has been conveyed to the target detection area Z using only the registration sensor 69. In such a case, it is necessary to determine that the paper P has been conveyed to the target detection area Z when the paper P has been conveyed a prescribed distance after the registration sensor 69 detects the paper P. However, this conceivable method will induce incorrect determinations if a paper jam occurs before the paper P reaches the target detection area Z. The multifunction device 1 of the present embodiment prevents such incorrect determinations by using both the registration sensor 69 and the media sensor 68.

In addition, the light amount adjusting process is performed when the light-emitting element 79 is located at a plurality of different positions A, B, and C on the paper P. These positions A, B, and C are symmetrical with one another and are separated by equal distances in the left-to-right direction as shown in FIG. 10. Even if one or two of the three positions A, B, and C were soiled, printed with some images, or wrinkled and therefore the light amount adjustment value determined at that position has a relatively large value, another light amount adjustment value that is determined at another position which is not soiled, not printed with any images, or not wrinkled and therefore that is smaller than the light amount adjustment value obtained at the problematic position can be set as the paper edge detecting current.

The light amount actually received by the light-receiving element 80 changes according to: the amount of light actually emitted from the light-emitting element 79; the sensitivity of the light-receiving element 80; the color density of the sheet of paper P; and the like. By adjusting the light amount emitted from the light-emitting element 79 dependently on the light amount actually received by the light-receiving element 80, it is possible to detect the edge positions of the paper P with high accuracy. Additionally, by adjusting the light amount emitted from the light-emitting element 79 dependently on the light amount actually received by the light-receiving element 80, the light-receiving element 80 will always receive a fixed amount of light from the sheet of paper P regardless of the color density of the sheet P. It is possible to detect the edge positions of any kinds of paper P with high accuracy.

Additionally, the difference between the first output level and second output level, which will affect resolution, can be maintained constant. It is possible to maintain a high level of detecting accuracy.

<Modifications>

In S240 of the process of FIG. 9, the paper edge detecting current is set to the smallest value from among the light amount adjustment values calculated for positions A, B, and C. However, the paper edge detecting current may also be set to an average of the light amount adjustment values at these positions A, B, and C. This method can improve reliability of the paper edge detecting current, and can particularly improve reliability as the number of positions at which the light amount adjusting process is performed increases.

Further, in the embodiment described above, the amount of light emitted by the light-emitting element 79 is adjusted by varying the amount of the electric current supplied thereto. However, the light amount may be adjusted according to other methods. For example, the light amount may be adjusted by a pulse width modulation method, that is, by changing the duty ratio of the pulse current supplied to the light-emitting element 79.

Further, in the multifunction device 1 of the embodiment described above, the paper guides 78 move symmetrically in the left-to-right direction, so that the widthwise centerline through the paper P is always fixed to the same position. Accordingly, the paper P always passes over the reference line RL in the center of the paper-conveying path, regardless of the paper size. By positioning the media sensor 68 on this reference line RL in S110, the multifunction device 1 can reliably detect when the paper P has been conveyed to the target detection area Z. It is noted, however, that one of the paper guides 78 may be fixed and only the other paper guide 78 may be moved. In such a case, the portion of the paper conveying path on the side of the fixed paper guide 78 (specifically, on the side wall 78A on the fixed paper guide 78) is used as the reference line RL over which the paper P always passes. Hence, reliable detection can be performed by positioning in S110 the media sensor 68 over the reference line RL or at a location slightly offset from the reference line RL toward the movable paper guide 78.

Instead of the reference line RL, a reference band area can be defined for such an area that extends in the sheet conveying direction, that has some fixed amount of width in the left-to-right direction, and on which the paper P always passes regardless of the size of the paper P when the paper P is conveyed. The media sensor 68 may be conveyed into this reference band area in S110.

<Second Embodiment>

In the first embodiment described above, the control unit 70 sets the amount of the paper detecting current to a value that is appropriate for the sheet of paper P prior to detecting the edge positions of the paper P so that the second output level will become a fixed target output value. However, in the present embodiment, the amount of the paper edge detecting current is set to a predetermined fixed value The second output level that the light-receiving element 80 outputs in response to light reflected from the paper P will therefore change dependently on the conditions of the respective positions on the paper P. According to the present embodiment, the control unit 70 sets the amount of the paper edge detecting threshold to a value that is suitable for the second output level that is outputted from the light-receiving element 80.

Figure 11:
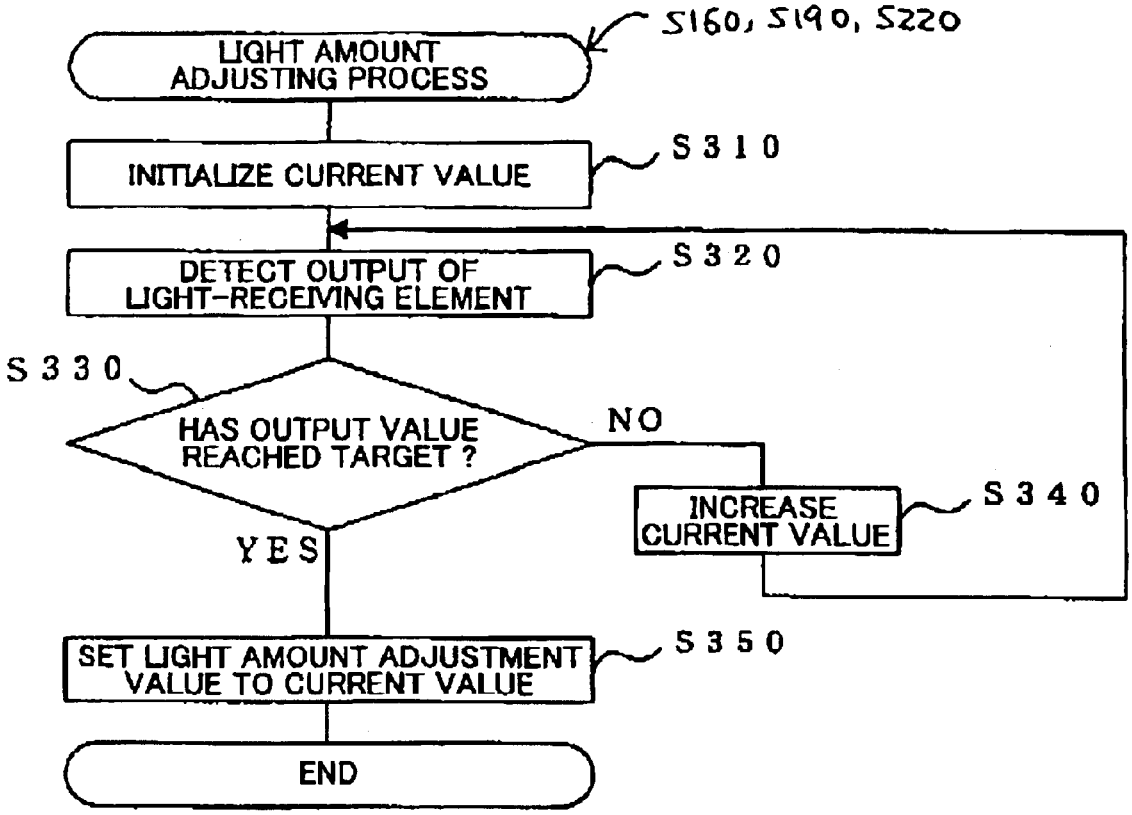
FIG. 11 is a flowchart showing steps in a light amount adjusting process executed in the process of FIG. 9.
Figure 13:
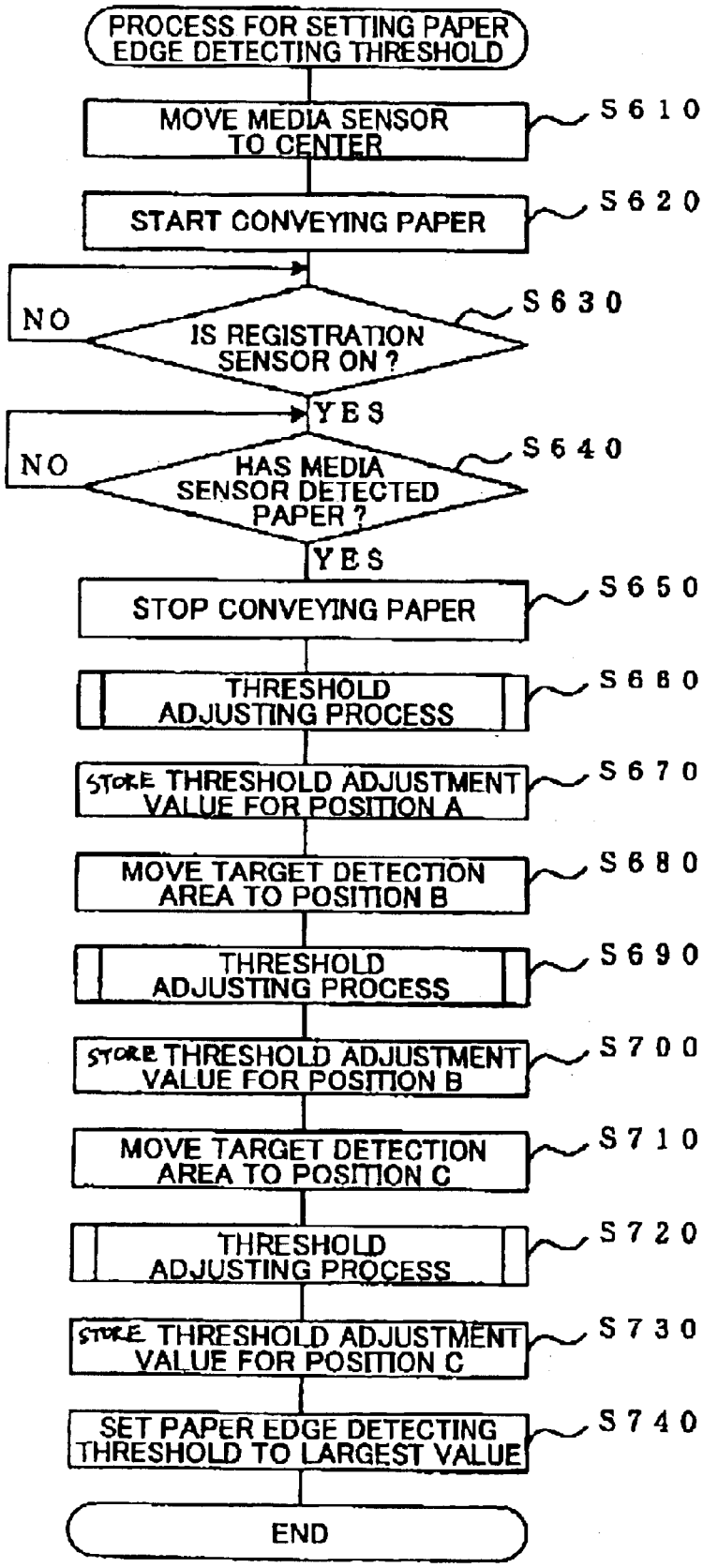
FIG. 13 is a flowchart showing the steps in a process for setting a threshold for paper edge detection according to a second preferred embodiment.
Figure 14:
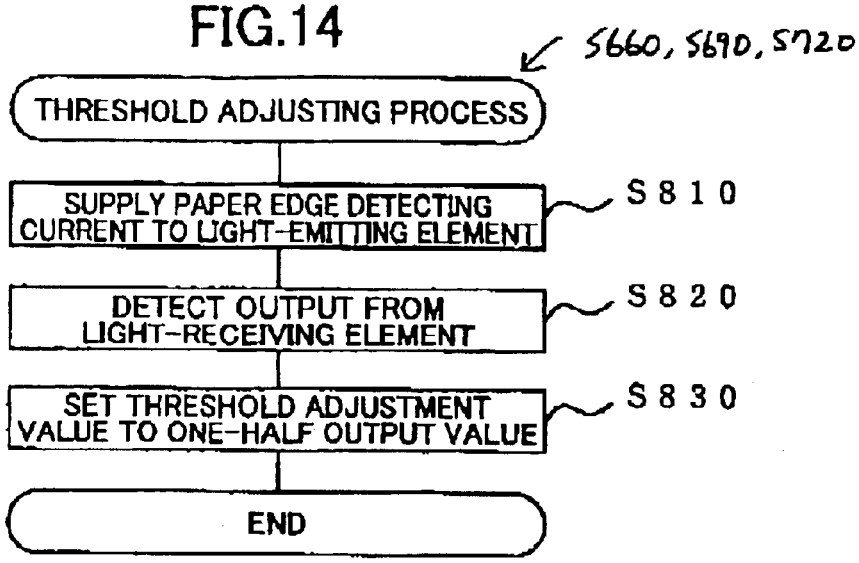
FIG. 14 is a flowchart showing the steps in a threshold adjusting process executed in FIG. 13.

Specifically, the control unit 70 according to the present embodiment executes a process for setting the paper edge detecting threshold shown in FIG. 13 and a threshold adjusting process shown in FIG. 14 in place of the process for setting the paper edge detecting current of FIG. 9 and the light amount adjusting process of FIG. 11.

Next the process for setting the paper edge detecting threshold will be described with reference to the flowchart in FIG. 13.

In this process, steps 5610–S650 are identical to steps S110–S150 of the process for setting the paper edge detecting current in FIG. 9. Therefore, a description of these steps is omitted.

In S660 the CPU 71 performs a threshold adjusting process to determine a threshold value that is suitable for the output value that the light-receiving element 80 outputs in response to light received from the target detection area Z (hereinafter referred to as the threshold adjustment value). At this time, the target detection area Z of the media sensor 68 is located at position A on the paper P (see FIG. 10).

The threshold adjusting process of S660 will be described below with reference to FIG. 14.

At the beginning of the threshold adjusting process, in S810, the CPU 71 supplies the paper edge detecting current (a fixed value in this case) to the light-emitting element 79, causing the light-emitting element 79 to emit light.

In S820 the CPU 71 detects the output value from the light-receiving element 80.

In S830 the CPU 71 sets the threshold adjustment value to one-half the output value detected in S820, and the threshold adjusting process ends. In other words, the threshold adjustment value is set to a value midway between the first output level and the second output level assuming that the first output level is equal to zero (0).

Then, the process proceeds to S670 (FIG. 13).

In S670, the control unit 70 stores the threshold adjustment value determined in S660 in the RAM 73 as the threshold adjustment value for position A.

In S680 the CPU 71 moves the carriage 11 so as to move the target detection area Z of the media sensor 68 to position B on the paper P (see FIG. 10).

In S690 the CPU 71 again performs the threshold adjusting process in the same manner as described in S660.

In S700 the CPU 71 stores the threshold adjustment value determined in S690 in the RAM 73 as the threshold adjustment value for position B.

In S710 the CPU 71 moves the carriage 11 so as to move the target detection area Z of the media sensor 68 to position C on the paper P (see FIG. 10).

In S720 the CPU 71 again performs the threshold adjusting process in the same manner as described in S660 and S690.

In S730 the CPU 71 stores the threshold adjustment value determined in S720 in the RAM 73 as the threshold adjustment value for position C.

In S740 the CPU 71 sets the amount of the paper edge detecting threshold to the largest value among the threshold adjustment values at positions A, B, and C, which are now stored in the RAM 73. Then, the process for setting the paper edge detecting threshold ends.

In this way, after setting the threshold adjustment values for the positions A, B, and C, in S740 the CPU 71 sets the paper edge detecting threshold to the largest value from among the threshold adjustment values for all the positions A, B, and C. If the position A, B, or C of the paper P were soiled, printed with some images, or wrinkled, the threshold adjustment value for such areas will be lower than a value that should be set to that position. Hence, it is likely that the higher threshold adjustment value is more appropriate. Accordingly, the paper edge detecting threshold is set to the largest value among the threshold adjustment values.

The same effects as those obtained in the first embodiment can also be attained by performing the process for setting the paper edge detecting threshold of FIG. 13 and the threshold adjusting process of FIG. 14 in place of the process for setting the paper edge detecting current of FIG. 9 and the light amount adjusting process of FIG. 11.

The light amount actually received by the light-receiving element 80 changes according to: the amount of light actually emitted from the light-emitting element 79; the sensitivity of the light-receiving element 80; the color density of the sheet of paper P; and the like. By adjusting the amount of the threshold dependently on the light amount actually received by the light-receiving element 80, it is possible to detect the edge positions of the paper P with high accuracy.

The light amount actually received by the light-receiving element 80 will possibly decrease at some position A, B, or C if that position is soiled, printed with images, or wrinkled. However, if the light amount actually received by the light-receiving element 80 at another position is greater than that received by the light-receiving element 80 from that problematic position, the paper edge detecting threshold is determined based on this greater light amount. It is possible to determine the paper edge detecting threshold without being affected by the differences in conditions at the respective positions on the sheet P.

Although the paper edge detecting threshold is set to the maximum value from among threshold adjustment values at positions A, B, and C in S740 (FIG. 13), the paper edge detecting threshold may be set to an average of the threshold adjustment values at positions A, B, and C, for example.

While the invention has been described in detail with reference to the specific embodiments thereof, it would be apparent to those skilled in the art that various changes and modifications may be made therein without departing from the spirit of the invention.

In the first embodiment, the light amount adjusting process for the light-emitting element 79 is performed at the plurality of locations on the paper P. Specifically, the control unit 70 performs these processes in the pattern shown in FIG. 10, but these processes may be performed in a variety of patterns other than this pattern. The following description assumes that the light amount adjusting process is performed at positions A, B, and C in this order.

Figure 15:
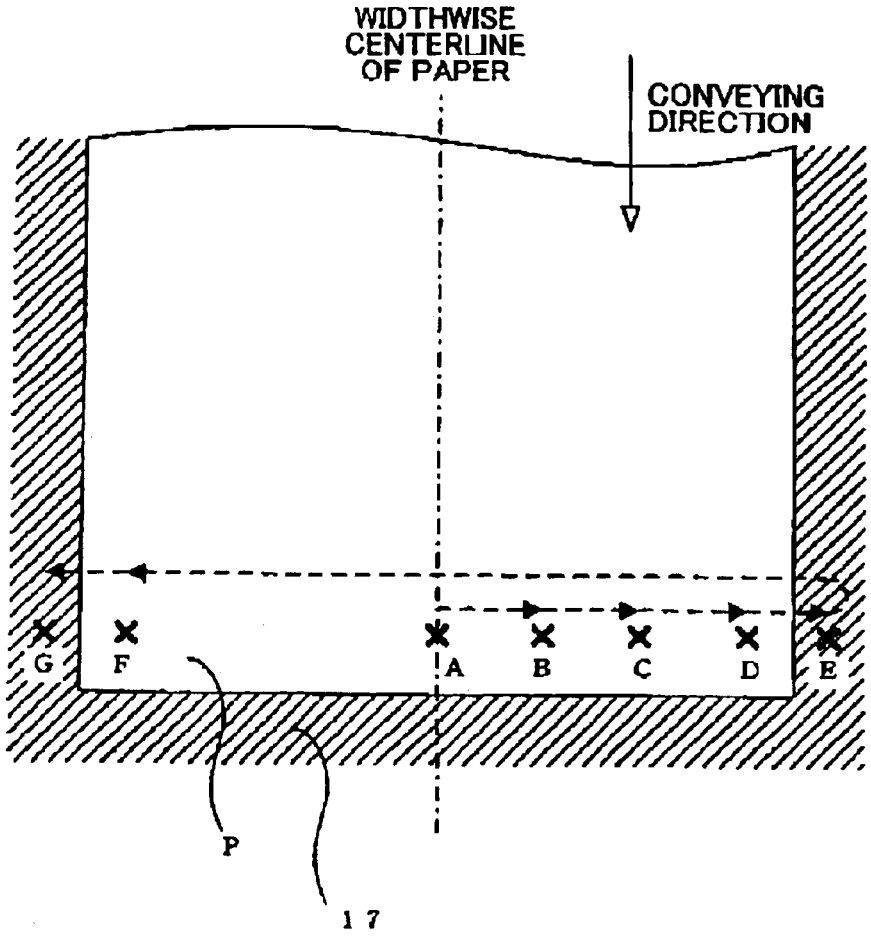
FIG. 15 is a second explanatory diagram showing areas on a paper at which a light amount adjustment process is performed according to a modification.

For example, as shown in FIG. 15, position A is located on the widthwise centerline of the paper P, while positions B and C are separated from position A by steps leading in one direction (toward the right in FIG. 15). This pattern avoids the reciprocal or bi-directional movement from position A to positions B and C in FIG. 10, thereby shortening the distance in which the target detection area Z is moved.

In the patterns shown in FIGS. 10 and 15, position A is located on the widthwise centerline of the paper P. When the media sensor 68 is disposed at position A, the paper P will reliably pass through the target detection area Z of the media sensor 68. Thus, the media sensor 68 can reliably detect when the paper P has been conveyed.

It is noted that position A need not be set on the widthwise centerline of the paper P but may be set on other locations on the paper P provided that the paper P will reliably pass through the target detection area Z when the media sensor 68 is disposed at position A.

For example, position A can be set at a location through which the paper P is known to pass when the size of the paper P being conveyed is known. Position A can be set at another position on a line extending through the registration sensor 69 (more specifically the probe 69*a*) in the conveying direction of the paper. Position A can also be set at another position through which a paper P of the minimum size that can be used on the multifunction device 1 will pass.

Figure 16:
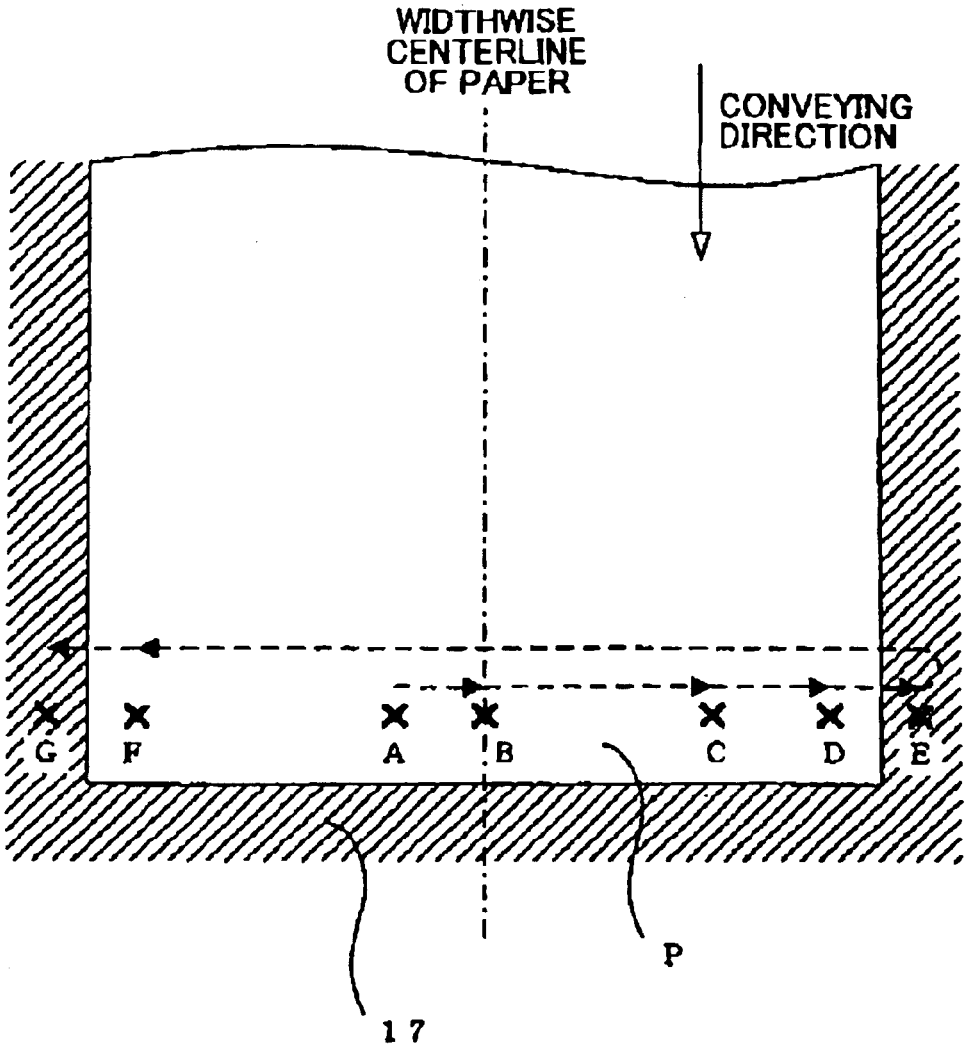
FIG. 16 is a third explanatory diagram showing areas on a paper at which a light amount adjustment process is performed according to another modification.

As shown in FIG. 16, position A may be located on one widthwise side of the paper P (the left side in FIG. 16) from the center line, while positions B and C are separated by steps from position A in the direction toward the centerline (rightward direction in FIG. 16). In this case, as in the first embodiment, the light amount adjusting process can be performed on both sides of the widthwise centerline running through the paper P. Further, this pattern can shorten the distance over which the target detection area Z is moved.

Figure 17:
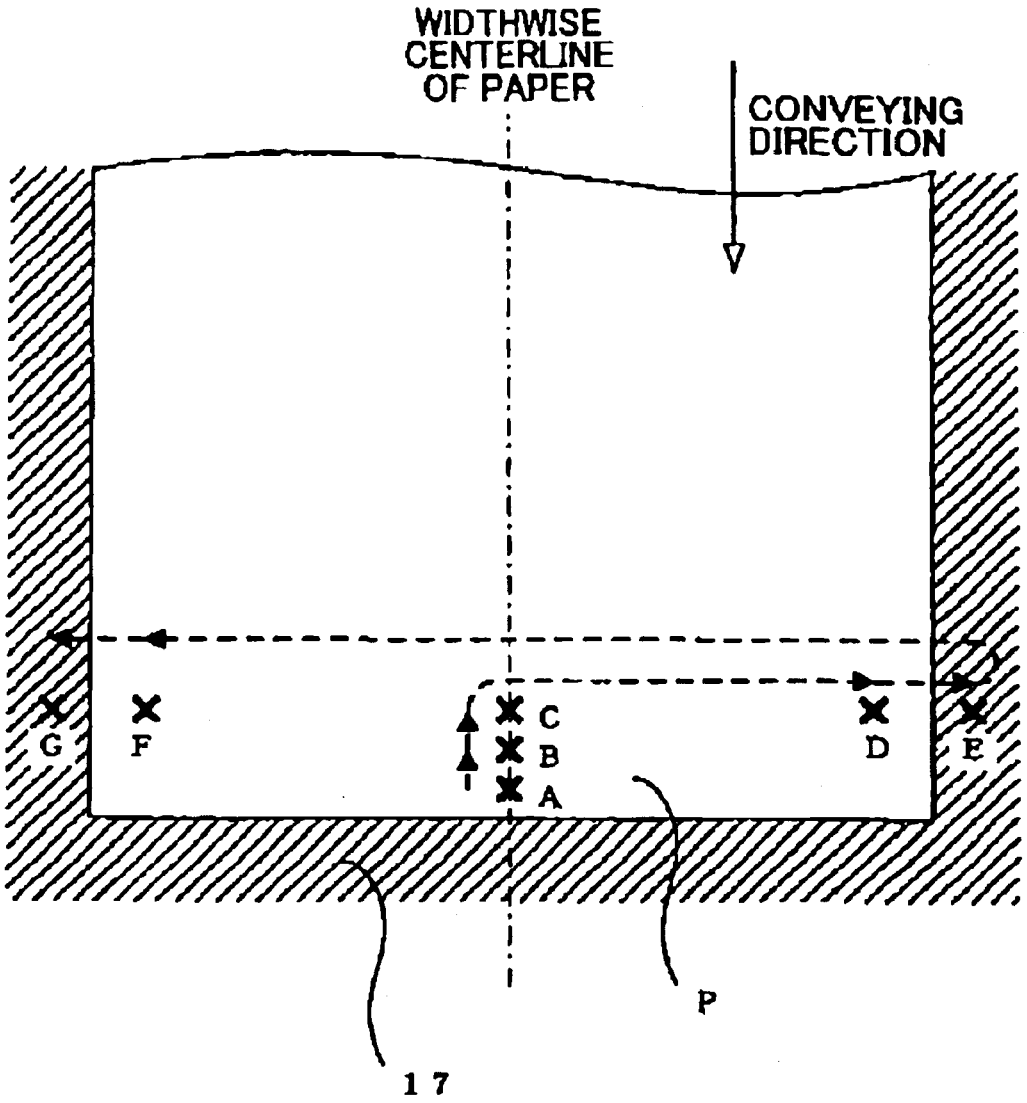
FIG. 17 is a fourth explanatory diagram showing areas on a paper at which a light amount adjustment process is performed according to another modification.

Positions A, B, and C may all be set along the widthwise centerline of the paper P, as shown in FIG. 17. In this example, the target detection area Z is moved from position A to positions B and C by conveying the paper P, while the position of the carriage 11 remains fixed. Accordingly, the light amount adjusting process can be started for positions A through C immediately after the media sensor 68 detects that the paper P has been conveyed to the target detection area Z. Consequently, this pattern can shorten the time required to determine the paper edge detecting current. In this modification, the light amount adjusting process may be performed in the opposite order from position C to positions B and A shown in FIG. 17.

In the second embodiment, the threshold adjusting process for the light-emitting element 79 is performed at the plurality of locations on the paper P. Specifically, the control unit 70 performs these processes in the pattern shown in FIG. 10, but these processes may be performed in a variety of patterns other than this pattern. For example, these processes may be performed in the patterns shown in FIGS. 15–17.

What is claimed is:

1. An edge-detecting device for detecting an edge of a medium, the device comprising:

a detecting unit that defines a target detection area, and that detects medium detection data at the target detection area, the medium detection data having a different value depending on whether or not a medium is present in the target detection area;

an adjusting unit that performs an adjusting operation by controlling the detecting unit to detect values of the medium detection data at a plurality of locations on the medium, thereby adjusting a determining condition based on the plurality of detected values; and an edge detecting unit that performs an edge detecting operation by controlling the detecting unit to detect a value of the medium detection data while moving the position of the target detection area in relation to the medium and by determining whether or not the medium is present in the target detection area based on the value detected by the detecting unit and by using the adjusted determining condition, thereby detecting an edge position of the medium;

wherein the detecting unit includes a reflection-type sensor having a light-emitting element and a light-receiving element, the light-receiving element receiving light reflected from the target detection area when the light-emitting element emits light, the light-receiving element outputting data indicative of an amount of light received by the light-receiving element as the medium detection data;

wherein the edge detecting unit determines whether the medium is present in the target detection area based on whether the amount of light received by the light-receiving element exceeds a threshold value; and wherein the adjusting unit includes a light-emitting adjusting unit that adjusts the amount of light emitted by the light-emitting element at the plurality of locations to such a value that causes the light-receiving element to receive light with an amount of a predetermined value.

2. An edge-detecting device according to claim 1, wherein the adjusting unit further includes a threshold adjusting unit that adjusts, as the determining condition, the amount of the threshold value to a value that corresponds to the predetermined value.

3. An edge-detecting device according to claim 1, wherein the light-emitting adjusting unit adjusts, as the determining condition, the amount of light emitted by the light-emitting element during the edge detecting operation based on the amounts of light that have been emitted by the light-emitting element at the plurality of locations on the medium.

4. An edge-detecting device according to claim 3, wherein the light-emitting adjusting unit sets the amount of light emitted by the light-emitting element during the edge detecting operation to the smallest value from among the amounts of light that have been emitted by the light-emitting element at the plurality of locations on the medium.

5. An edge-detecting device according to claim 3, wherein the light-emitting adjusting unit sets the amount of light emitted by the light-emitting element during the edge detecting operation to an average value among the amounts of light that have been emitted by the light-emitting element at the plurality of locations on the medium.

6. An edge-detecting device according to claim 3, wherein the light-emitting adjusting unit adjusts the amount of light emitted by the light-emitting element by varying an amount of an electric current supplied to the light-emitting element.

7. An edge-detecting device according to claim 3, wherein the light-emitting adjusting unit adjusts the amount of light emitted by the light-emitting element by varying a duty ratio of a pulse electric current supplied to the light-emitting element.

8. An image-forming device for forming images on a recording medium, the device comprising:

a conveying unit that conveys the recording medium in a recording-medium conveying direction;

a recording unit that moves substantially orthogonal to the recording-medium conveying direction and that performs a recording operation to form images on the recording medium; and an edge-detecting device that detects an edge of a medium, the edge-detecting device including:

a detecting unit that defines a target detection area and that detects medium detection data at the target detection area, the medium detection data having a different value depending on whether or not a medium is present in the target detection area;

an adjusting unit that performs an adjusting operation by controlling the detecting unit to detect values of the medium detection data at a plurality of locations on the medium, thereby adjusting a determining condition based on the plurality of detected values; and an edge detecting unit that performs an edge detecting operation by controlling the detecting unit to detect a value of the medium detection data while moving the position of the target detection area in relation to the medium and by determining whether or not the medium is present in the target detection area based on the value detected by the detecting unit and by using the adjusted determining condition, thereby detecting an edge position of the medium, the edge detecting unit detecting both side edge positions of the recording medium that is conveyed by the conveying unit, the recording unit performing the recording operation between both side edge positions of the recording medium detected by the edge detecting units;

wherein the detecting unit includes a reflection-type sensor having a light-emitting element and a light-receiving element, the light-receiving element receiving light reflected from the target detection area when the light-emitting element emits light, the light-receiving element outputting data indicative of an amount of light received by the light-receiving element as the medium detection data;

wherein the edge detecting unit determines whether the medium is present in the target detection area based on whether the amount of light received by the light-receiving element exceeds a threshold value;

wherein the adjusting unit includes a light-emitting adjusting unit that adjusts the amount of light emitted by the light-emitting element at the plurality of locations to such a value that causes the light-receiving element to receive light with an amount of a predetermined value;

wherein the adjusting unit includes a threshold adjusting unit that adjusts, as the determining condition, the amount of the threshold value to a value that corresponds to the predetermined value; and wherein the light-emitting adjusting unit adjusts, as the determining condition, the amount of light emitted by the light-emitting element during the edge detecting operation based on the amounts of light that have been emitted by the light-emitting element at the plurality of locations on the medium.

9. An image-forming device according to claim 8, further comprising a moving device that moves the detecting unit and the recording unit in an integral state;

wherein the adjusting unit controls the detecting unit to detect the value of the medium detection data at the plurality of locations on the recording medium as the recording unit moves.

10. An image-forming device according to claim 8, wherein the adjusting unit controls the detecting unit to detect a value of the medium detection data at the plurality of locations on the recording medium as the conveying unit conveys the recording medium.

11. An image-forming device according to claim 8, wherein the edge-detecting device further comprises an adjustment-start control unit controlling the detecting unit to detect the medium detection data when a leading edge of the recording medium initially passes through the target detection area as the conveying unit conveys the recording medium, thereby determining whether the recording medium has been conveyed to the target detection area based on values of the medium detection data detected by the detecting unit, wherein the adjustment-start control unit controls the adjusting unit to start executing the adjusting operation after the adjustment-start control unit determines that the recording medium has been conveyed to the target detection area.

12. An image-forming device according to claim 11, further comprising:

a recording medium detecting unit that is provided at a recording-medium detecting position upstream from the position at which the detecting unit is capable of detecting the medium detection data and that detects whether the recording medium has been conveyed to the recording-medium detecting position by the conveying unit;

wherein the adjustment-start control unit determines whether the recording medium has been conveyed into the target detection area after the recording medium detecting unit detects that the recording medium has been conveyed to the recording-medium detecting position.

13. An image-forming device according to claim 8, wherein the adjusting unit controls the detecting unit to detect the value of the medium detection data at the plurality of locations on the recording medium that are separated from one another at equal intervals.

14. An image-forming device according to claim 8, wherein the adjusting unit controls the detecting unit to detect the value of the medium detection data at the plurality of locations on the recording medium that are symmetrical with one another in relation to a centerline through the recording medium that is defined along the recording-medium conveying direction.

15. An image-forming device according to claim 8, wherein the conveying unit conveys the recording medium so that the recording medium passes over a reference line extending in the recording-medium conveying direction, regardless of the size of the recording medium; and the adjusting unit controls the detecting unit to detect the value of the medium detection data at the plurality of locations on the recording medium, with at least one location being positioned on the reference line.

16. An image-forming device according to claim 15, wherein the adjusting unit controls the detecting unit to detect the value of the medium detection data first at a location on the recording medium positioned on the reference line.

* * * * *